US009067147B1

(12) United States Patent
Woodhouse

(10) Patent No.: US 9,067,147 B1
(45) Date of Patent: Jun. 30, 2015

(54) TOY FIGURE COMBINERS

(71) Applicant: Hasbro, Inc., Pawtucket, RI (US)

(72) Inventor: Richard Woodhouse, North Scituate, RI (US)

(73) Assignee: Hasbro, Inc., Pawtucket, RI (US)

( * ) Notice: Subject to any disclaimer, the term of this patent is extended or adjusted under 35 U.S.C. 154(b) by 171 days.

(21) Appl. No.: 13/786,660

(22) Filed: Mar. 6, 2013

Related U.S. Application Data

(60) Provisional application No. 61/771,012, filed on Feb. 28, 2013.

(51) Int. Cl.
*A63H 3/16* (2006.01)

(52) U.S. Cl.
CPC ..... *A63H 3/16* (2013.01)

(58) Field of Classification Search
USPC ..... 446/85, 97, 99, 101, 102, 104, 108, 111
See application file for complete search history.

(56) References Cited

U.S. PATENT DOCUMENTS

| | | | | |
|---|---|---|---|---|
| 1,746,839 | A * | 2/1930 | Main et al. | 446/100 |
| 3,870,312 | A * | 3/1975 | Hamar | 273/276 |
| D253,711 | S | 12/1979 | Christiansen et al. | |
| 4,203,248 | A | 5/1980 | Tapdrup | |
| 4,205,482 | A * | 6/1980 | Christiansen et al. | 446/97 |
| 4,571,203 | A | 2/1986 | Murakami | |
| 4,580,993 | A | 4/1986 | Ohno | |
| D287,381 | S | 12/1986 | Ohno | |
| 4,643,691 | A | 2/1987 | Keiji | |
| 4,673,373 | A | 6/1987 | Herring et al. | |
| 4,988,324 | A | 1/1991 | Ryaa et al. | |
| 5,752,869 | A | 5/1998 | Huff | |

(Continued)

FOREIGN PATENT DOCUMENTS

| | | |
|---|---|---|
| EP | 0856341 | 8/1998 |
| GB | 1313277 | 4/1973 |

(Continued)

OTHER PUBLICATIONS

Instructions for Saban's Power Rangers Samurai Megazord posted by Bandai America Incorporated at http://web.archive.org/liveweb/http://www.bandai.com/powerrangers/samurai/upload/INS-426F6FE.pdf and archived on Apr. 14, 2012, 3 pages.

(Continued)

*Primary Examiner* — Kurt Fernstrom
(74) *Attorney, Agent, or Firm* — DiBerardino McGovern IP Group LLC

(57) ABSTRACT

A toy construct assembly system is designed for use with standardized toy construction building elements having standardized multiple male and female coupling elements. The system includes several small toy constructs, each having building elements and additional build parts that assemble to create the small toy construct in at least two distinct builds and then dissemble into its constituent parts. Each build of the small toy construct includes a small figure assembled from the building elements to which a plurality of the additional build parts are detachably coupled to create an assembled small toy construct. In addition, a combiner assembly set includes combiner assemblies that detachably couple with building elements of the small toy construct to create a large toy construct. The large toy construct is assembled from the plurality of small toy constructs and the combiner assembly set.

25 Claims, 29 Drawing Sheets

(56) References Cited

U.S. PATENT DOCUMENTS

| | | | | |
|---|---|---|---|---|
| 5,913,706 | A | 6/1999 | Glickman et al. | |
| 6,213,839 | B1 | 4/2001 | Pedersen | |
| 6,287,166 | B1 | 9/2001 | Lee et al. | |
| 6,328,625 | B1 | 12/2001 | Lee et al. | |
| 6,478,653 | B1 | 11/2002 | Langton | |
| 6,482,063 | B1 | 11/2002 | Frigard | |
| 6,692,332 | B2 | 2/2004 | Jheow | |
| 7,467,986 | B2 | 12/2008 | Hanamoto et al. | |
| 7,553,209 | B1 * | 6/2009 | Sorensen | 446/124 |
| 7,568,965 | B2 | 8/2009 | Toriyama et al. | |
| D608,400 | S * | 1/2010 | Ryaa | D21/500 |
| 7,662,016 | B2 | 2/2010 | Okamoto et al. | |
| 7,722,429 | B2 | 5/2010 | Campbell | |
| 7,785,168 | B2 | 8/2010 | Yamada et al. | |
| D630,264 | S * | 1/2011 | Ryaa | D21/499 |
| 8,011,992 | B2 | 9/2011 | Ejima | |
| 8,066,542 | B2 | 11/2011 | Ejima | |
| 8,142,252 | B1 * | 3/2012 | Krull | 446/268 |
| 8,162,713 | B2 | 4/2012 | Kasahara et al. | |
| 8,187,049 | B2 | 5/2012 | Corsiglia et al. | |
| D662,154 | S | 6/2012 | Hara et al. | |
| 8,337,271 | B2 | 12/2012 | Campbell | |
| 2012/0142247 | A1 | 6/2012 | Hara et al. | |
| 2012/0142248 | A1 | 6/2012 | Murayama et al. | |

FOREIGN PATENT DOCUMENTS

| | | |
|---|---|---|
| WO | 2012052475 | 4/2012 |
| WO | 2012052509 | 4/2012 |
| WO | 2012052541 | 4/2012 |

OTHER PUBLICATIONS

Product description for OLLO FIGURE produced by Robotis at http://web.archive.org/web/20110424031307/http://www.robotis.com/lightbox/ollo__figure__en.html and archived on Apr. 24, 2011, 3 pages.

Product description for OLLO produced by Robotis at http://web.archive.org/web/20120112093742/http://www.robotis.com/xe/ollo__en and archived on Jan. 12, 2012, 6 pages.

Instruction manual for Transformers Star Wars Darth Vader/Death Star, Item 87524, issued by Hasbro and sold prior to Mar. 1, 2012 and captured at http://www.transformertoys.co.uk/images/instruction-scans/hasbro/transformers+star+wars+darth+vader+death+star+instructions.pdf.

Lego Bionicle Gelu 8988-1, description found at http://web.archive.org/web/20111020170104/http://brickset.com/detail/?Set=8988-1 on Oct. 20, 2011, 2 pages.

Lego Bionicle Bitil 8696-1, description found at http://web.archive.org/web/20111019114211/http://brickset.com/detail/?Set=8696-1 on Oct. 19, 2011, 2 pages.

* cited by examiner

TOY FIGURE COMBINERS

TECHNICAL FIELD

The disclosed subject matter relates to combinable toy elements.

BACKGROUND

Children and adults enjoy interacting with and collecting toys. Toys that may be assembled, disassembled, reassembled, and reconfigured are historically popular and educational. These toys help develop hand eye coordination, fine motor skills, and stimulate creativity while providing endless hours of enjoyment and entertainment for children and adults alike.

In particular, construction toys that include interlocking and connecting plastic building elements promote creative and imaginative play by end users. Typically, plastic building elements attach to each other or interlock using an array of small cylindrical bumps or studs on the top surface of one building element that fit into an array of holes or recesses on the bottom surface of another building element. In general, the size and spacing of the studs and holes are standardized to enable attachment among various types of building elements and accessories that can be included in one or more construction toy kits.

A construction toy kit can include a standard set of pieces that allow end users to design and create a variety of different constructs. A construction toy kit also may provide instructions for using certain pieces to build a particular construct. In some cases, construction toy kits can be associated with particular themes for assembling constructs representing historical, contemporary, futuristic, or fictional structures.

In addition to building elements, construction toy kits often include small plastic toy figures to enhance play. Typically, the toy figures are about 1.5 inches tall and include head, arms, hands, torso, waists, and legs parts. The toy figures may represent characters associated with a particular theme and generally are structured to connect to the building elements and carry accessories, such as small plastic tools.

SUMMARY

In one general aspect, a large toy construct is configured for use with standardized toy construction building elements having standardized male and female coupling elements. The large toy construct is assembled from a plurality of small toy constructs and a combiner assembly set. Each small toy construct includes a small toy figure including a small core building element and additional build parts that may be assembled to create the small toy construct and then dissembled into its constituent parts. The small core building element includes a torso construct building element and a waist construct building element, the construct building elements include two joint elements, and the combiner assembly set includes a waist construct building element and a plurality of hinged combiner assemblies. Each hinged combiner assembly is configured to be assembled by an end user in one of a first orientation and a second orientation. The large toy construct includes a large toy figure. The large toy figure includes a head building element; a trunk building element; a first pair of hinged combiner assemblies; a second pair of hinged combiner assemblies.

The trunk building element includes a first torso construct building element of a small toy figure of a first small toy construct removeably attached to a second torso construct building element of a small toy figure of a second small toy construct that is removeably attached to the waist construct building element of the combiner set.

One of the hinged combiner assemblies of the first pair is assembled in the first orientation and the other of the hinged combiner assemblies of the first pair is assembled in the second orientation. Each of the hinged combiner assemblies of the first pair include a first special connector removeably attached to a second special connector, the first special connectors of the hinged combiner assemblies of the first pair each removeably attached to one of the two joints of the first torso construct building element.

One of the hinged combiner assemblies of the second pair is assembled in the first orientation and the other of the hinged combiner assemblies of the second pair is assembled in the second orientation. Each of the hinged combiner assemblies of the second pair includes a first special connector removeably attached to a second special connector, the second special connectors of the combiner assemblies of the second pair each removeably attached to one of the two joints of the waist construct building element of the combiner set.

The large toy figure also includes a pair of small core building elements of a small toy figure of a third and fourth small toy construct removeably attached to the second special connectors of the second pair of hinged combiner elements; and a pair of remainders of the small core building elements of the small toy figures of the first and second small toy constructs, removeably attached to the second special connectors of the first pair of hinged combiners.

Implementations can include one or more of the following features. For example, removeably attached elements can be removeably attached with an interference fit.

The first special connectors can each include a socket removeably attached to a joint of the attached construct elements using a snap fit and the second special connectors include a bore hole removeably attached to a post of the attached construct elements using a non-snap, friction fit. The first special connectors can each include a socket removeably attached to a joint of the attached construct elements using a snap fit to create a joint system having a range of motion in three dimensions. The first special connector can include a C grip of the second coupling size that is removeably attached using a snap fit to a rod of a hinge portion of the second special connector to form a hinged joint system.

Each of the small toy constructs can be configured to be assembled into two different builds using specific parts of each small toy construct that are removeably attached to the core elements of each small figure of the small toy constructs to create the two different builds that are distinct for each small toy construct. And, the large toy construct can include a plurality of parts removeably attached to the large toy figure to create the large toy construct, the plurality of parts including at least one specific part from each small construct of the first small construct, the second small construct, the third small construct, and the fourth small construct. The two different builds can be a robotic build and a vehicle build.

The hinge joint system can provide a range of motion for the first and second special connectors of at least 180 degrees within a plane orthogonal to the longitudinal axis of the rod. The first special connector can include an arm portion arranged in a first plane and a generally cylindrical portion extending orthogonally from one end of the arm portion to a rounded end, the rounded end including a socket removeably attached to a joint of the attached construct element using a snap fit, and the C grip disposed at another end of the arm portion in the first plane and having a longitudinal axis or axis of rotation orthogonal to the first plane and coincident with the longitudinal axis of the rod.

The first special connector and the second special connector can each include at least one male coupling element and at least one female recess sized to receive the male coupling element.

Each of the small toy constructs can include parts of the small toy construct that are removeably attached to the core elements of each small toy figure of the small toy constructs to create a build of the small toy construct, and the large toy construct can include a plurality of the parts of the small toy constructs attached to the large toy figure to create the large toy construct, the plurality of parts including at least one part attached to at least one of the male connectors of each first and second special connectors.

In another general aspect, a combiner assembly set for a large toy construct is configured for use with a standardized toy construction building elements having standardized male and female coupling elements providing assembly of the large toy construct from multiple small toy constructs including construct building elements. The combiner assembly set includes a construct building element including two joint elements, and a plurality of hinged combiner assemblies. Each combiner assembly includes a first special connector and a second special connector. The first special connector includes a socket located proximal to one end of the first special connector and sized to mate with a joint element of any construct building element via a snap fit; and a C grip disposed at another end of the first special connector. The second special connector includes a hinge portion configured at one end of the second special connector, the hinge portion including a rod removably attached to the C grip of the first special connector via a snap fit in either one of two orientations that are 180 degrees opposite of each other to create a hinged joint system; and a bore hole configured at an opposite end of the second special connector and of size and depth to receive a post of any construct building element.

Implementations can include one or more of the following features. For example, the hinge joint system can provide a range of motion for the first and second special connectors of at least 180 degrees within a plane orthogonal to the longitudinal axis of the rod.

The first special connector can include an arm portion arranged in a first plane and a generally cylindrical portion extending orthogonally from one end of the arm portion to a rounded end of the cylindrical portion, the socket being disposed in the rounded end of the cylindrical portion, and the C grip disposed at another end of the arm portion in the first plane and having a longitudinal axis or axis of rotation orthogonal to the first plane.

The first special connector and the second special connector can each include at least one male coupling element and at least one female recess that receives a male coupling element.

In another general aspect, a combiner assembly for a large toy construct is configured for use with a standardized toy construction building elements having standardized male and female coupling elements providing the large toy construct assembled from multiple small toy constructs. The combiner assembly includes a first special connector and a second special connector. The first special connector includes a socket located proximal to one end of the first special connector and sized to mate with the joint elements of a construct building element of any small toy construct used to assemble the large toy construct via a snap fit; and a C grip disposed at another end of the first special connector. The second special connector includes a hinge portion configured at one end of the second special connector, the hinge portion including a rod of the second coupling size removably attached to the C grip of the first special connector via a snap fit in either one of two orientations that are 180 degrees opposite of each other to create a hinged joint system; and a bore hole configured at an opposite end of the second special connector and of size and depth to receive a post of a construct building element of any of the small toy constructs used to assemble of the large toy construct.

Implementations can include one or more of the following features. For example, the hinge joint system can provide a range of motion for the first and second special connectors of at least 180 degrees within a plane orthogonal to the longitudinal axis of the rod.

The first special connector can include an arm portion arranged in a first plane and a generally cylindrical portion extending orthogonally from one end of the arm portion to a rounded end of the cylindrical portion, the socket being disposed in the rounded end of the cylindrical portion, and the C grip disposed at another end of the arm portion in the first plane and having a longitudinal axis or axis of rotation orthogonal to the first plane.

The first special connector and the second special connector can each include at least one male coupling element and at least one female recess sized to receive the male coupling element.

In another general aspect, a toy construct assembly system is configured for use with standardized toy construction building elements having standardized multiple male and female coupling elements. The toy construct assembly system includes two or more small toy constructs, a large construct combiner assembly set, and a large toy construct. Each small toy construct includes a plurality of building elements and additional build parts that assemble to create the small toy construct in at least two distinct builds and then dissemble into its constituent parts, each build of the small toy construct including a small figure assembled from the building elements to which a plurality of the additional build parts are detachably coupled to create an assembled small toy construct. The large construct combiner assembly set includes a plurality of combiner assemblies configured to detachably couple with building elements of the small toy construct. The large toy construct is assembled from the plurality of small toy constructs and the large construct combiner assembly set, where a portion of each small figure is detachably coupled with the combiner assembly set to assemble a large toy figure to which a plurality of the additional build parts are detachably coupled to create an assembled large toy construct.

Implementations can include one or more of the following features. For example, one assembled build of the small toy construct can be a vehicle and another assembled build of the same small toy construct can be a robot.

Other features will be apparent from the description, the drawings, and the claims.

DESCRIPTION OF THE DRAWINGS

The present disclosure is further described in the detailed description that follows, in reference to the noted drawings by way of non-limiting examples, in which like reference numerals represent similar parts throughout the several views of the drawings, and wherein.

DETAILED DESCRIPTION

Figure 1A:
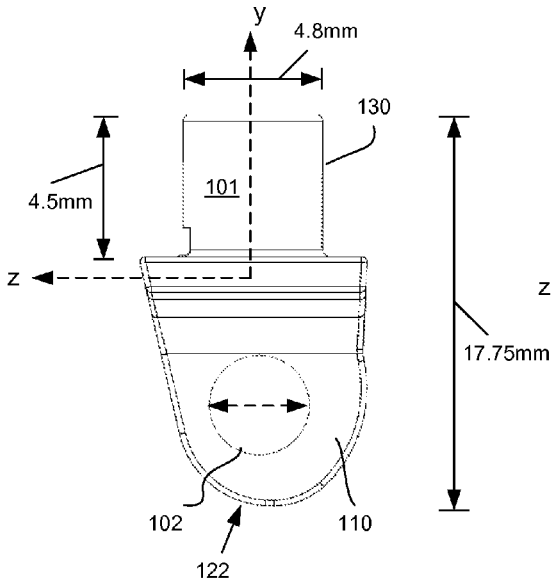
FIG. 1A is a side view of an exemplary waist construct element.

A construction toy system is described herein that includes small constructs that can be built, assembled, disassembled, reassembled, and reconfigured. Each small construct includes a number of build elements (for example, parts, pieces, and/or accessories), which can be assembled into at least two builds for example, a robotic build and a vehicle build). In addition, a set of small constructs can be partially disassembled and built, assembled, and reconfigured to create a large construct. Both the small constructs and the large construct may be disassembled, reassembled, and reconfigured countless times and in many different configurations to provide hours of enjoyment, entertainment, and creative stimulation. An example of a large construct is shown in FIG. 24B and a large figure that forms the large construct of FIG. 24B is shown in FIG. 23C. An example of a robotic build for a small construct that can be incorporated into the large construct of FIG. 24B is shown in FIG. 10C.

In general, the small constructs, the large construct, and the build elements are designed and manufactured to have dimensions that correspond to certain dimensions of a standard building element, stud, and/or accessory included in toy construction kits or sets, (such as bricks, plates, and specialized build elements and accessories). For instance, a standard building element such as a 1×1 plate may have a length of 7.80 mm, a width of 7.80 mm, and a height of 3.20 mm (not including the stud), and a standard building element such as a 1×1 brick may have a length of 7.80 mm, a width of 7.80 mm, and a height of 9.6 mm (not including the stud). Building elements also may include one or more coupling elements. Coupling elements of the standard building elements may be male and in the form of a coupling stud, or may be female and in the form of a coupling recess that is sized to receive the coupling stud. The male and female coupling elements may have a first coupling size. For example, the first coupling size of a standard coupling stud (that is on the surface of a building element) is defined by an outside diameter of 4.88 mm and a height of 1.80 mm, and the coupling recesses are sized to have an interference fit with the coupling studs. There can be different types and configuration of female recesses that mate with the first coupling size. For example, in some configurations, the recesses may be circular, partially circular with flats on multiple sides, square, or pronged to name a few. The recesses may have varying depths; however, a minimum depth may be provided to ensure proper coupling with the male stud via an interference fit.

An interference fit is a friction fit in which the mechanical coupling or fastening between the coupling elements is achieved by friction after the coupling elements are pushed together, mated, seated, or otherwise mutually engaged. The interference fit also may involve a purposeful interference or deformation of one or more of the coupling elements when they are coupled, fastened, pushed together, or otherwise mutually engaged. Thus, the interference fit can be achieved by shaping the two coupling elements so that one or the other, or both, slightly deviate in size or form from their nominal dimension and one or more of the coupling elements slightly interferes with the space that the other is taking up.

A particular type of interference fit includes a snap-fit where the element-to-element attachment is accomplished with a locator component and a locking component that are homogenous with one or the other of the elements being joined. Joining requires the flexible locking component of one element to move or deform for complete engagement with a mating element, followed by return of the locking component toward its original position or form to accomplish the interference required to couple, lock, and join the components together. The locator component of the mating element typically is inflexible, minimally or non-deforming so to provide strength and stability to the attachment. In one example, two coupling elements are engaged in a snap fit to form a mechanical joint system wherein the build elements are able to be moved relative to each other or configured in different positions while the pieces remain mechanically joined or locked together.

A toy construction kit also can include other building elements that include one or more accessory coupling elements that have a second coupling size that is distinct from (for example, smaller than) the first coupling size so that the accessory coupling elements are not able to frictionally engage with the coupling elements of the standard building elements of the first size. For example, the second coupling size of standard accessories, such as rods, handles, and guns that are held by toy figures or placed within hollow cutout portions of standard sized studs are defined by a outside diameter of 3.18 mm.

The parts and pieces that form the small and large constructs, building elements, and any other accessories can be formed from plastic, such as, for example, acrylonitrile butadiene styrene (ABS) or any other suitable material. While not shown, the pieces that form the small and large constructs, building elements, and any other accessories may be an assortment of different colors and may be decorated in various ways, for example, with paint, decals, stickers, etchings, imprints, to represent a character or build associated with a particular theme, real or imaginary, for example, according to a particular product line.

The following description makes reference to special relations in addition to directional orientations, such as views with regard to the figures. However, any terms such as up, down, left, right, top, bottom, front, back, above, below, upper, lower, and the like are used primarily to differentiate between the views and orientations relative to other building elements or pieces within any particular configuration, or series of views or illustrations, and to help describe the relationship between pieces to the reader. These terms are not intended to describe necessary real world orientations, unless otherwise noted or specified herein.

Figure 1B:
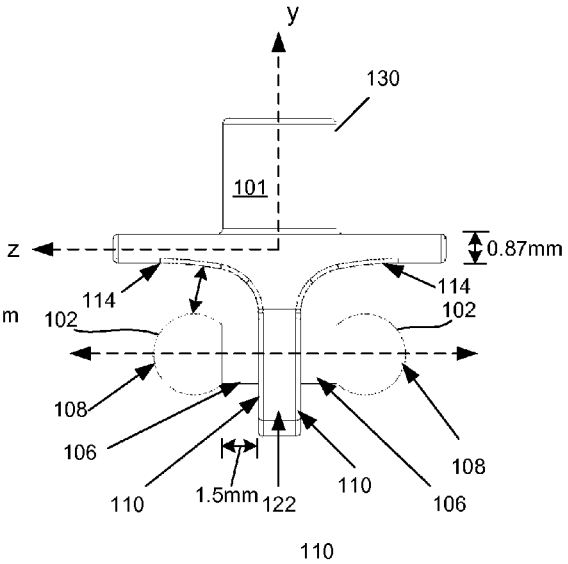
FIG. 1B is a front/back view of an exemplary waist construct element.
Figure 1C:
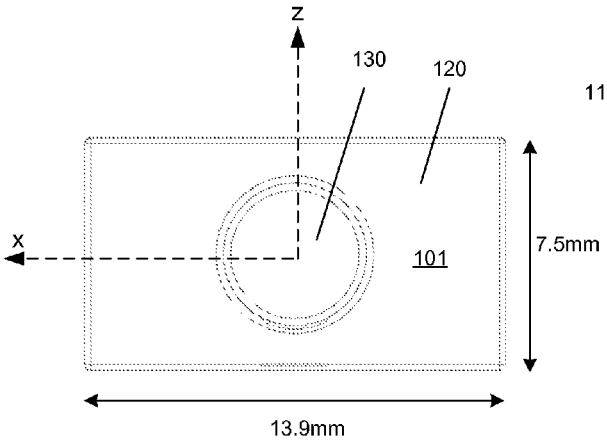
FIG. 1C is a top view of an exemplary waist construct element.
Figure 1D:
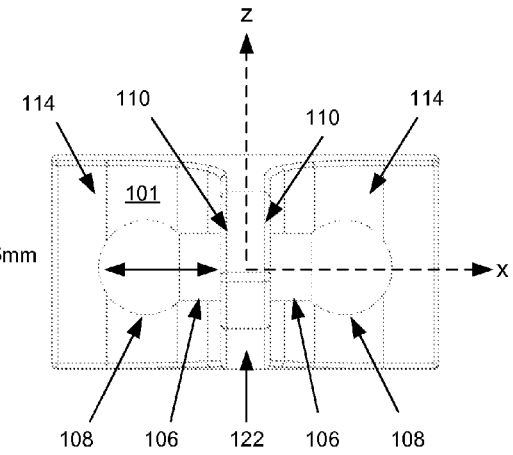
FIG. 1D is a bottom view of an exemplary waist construct element.
Figure 1E:
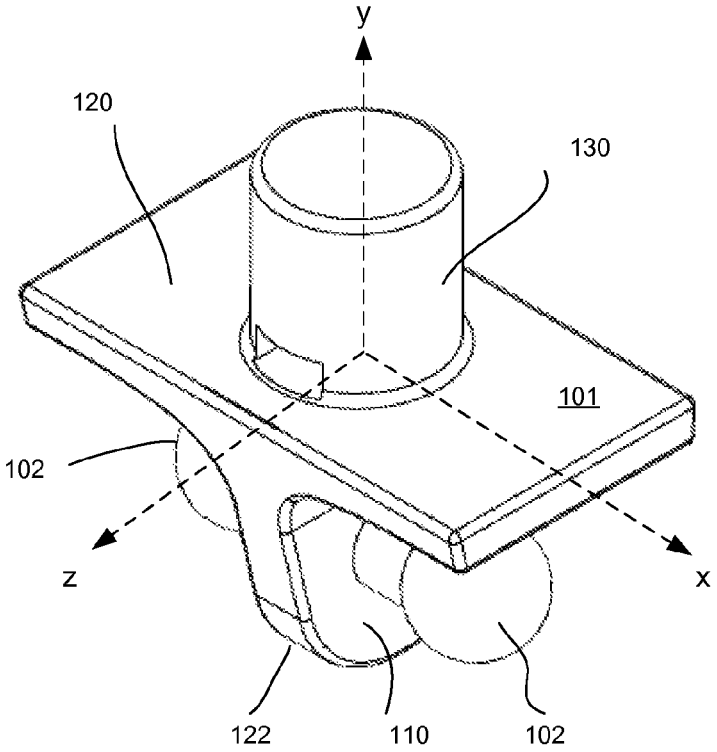
FIG. 1E is a first perspective view of an exemplary waist construct element.
Figure 1F:
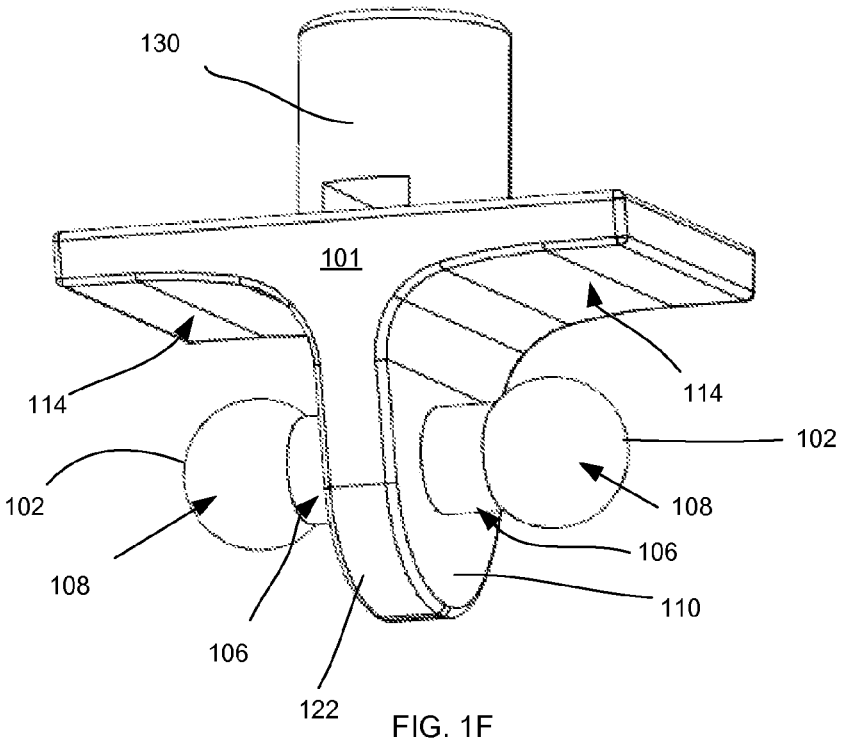
FIG. 1F is a second perspective view an exemplary waist construct element.
Figure 2A:
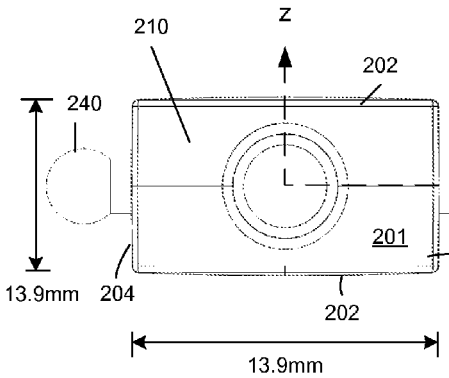
FIG. 2A is a top view of an exemplary torso construct element.

FIGS. 2A-1F show an example of a waist construct element 101. FIG. 1A is a side view of the waist construct element 101; FIG. 1B is a front/back view of the waist construct element 101; FIG. 1C is a top view of the waist construct element 101; FIG. 1D is a bottom view of the waist construct element 101; FIG. 1E is a first perspective view of the waist construct element 101; and FIG. 1F is a second perspective view the waist construct element 101.

The waist construct element 101 is a partially symmetrical, three dimensional building element, which may be constructed as unitary piece. As shown in FIGS. 1A-F, one half of the waist construct element mirrors the other half of the waist construct element, as viewed through the y-z plane. Generally, the corners and edges of the waist construct element 101 may be rounded. The waist construct element 101 includes two hip joint elements 102 arranged on a first axis 104 that is perpendicular to the y-z plane. The joint elements 102 may be constructed as a stud 106 and a partial ball 108 combination that is perpendicular to and extends from a first portion 110 of the surface of a side wall of the lower waist construct element 101 arranged in the y-z plane. The joint element 102 may be sized so as to engage with, mate, and lock with another building element having an appropriately sized hole, indentation, or socket via a snap fit to form a joint system. In one example, the stud 106 has a diameter 2.5 mm and length 1.5 mm.

The outer surface of the wall generally curves from the first portion 110 in the y-z plane to a second portion 114 of the wall arranged in the x-z plane that is orthogonal to the first portion 110. The second portions 114 on either side of the z-y plane together form a generally rectangular base 120 substantially parallel to the x-z plane and orthogonal to the z-y plane. The curved portion 116 of the wall is generally formed at distance from the ball portion 108 with a similar curvature as the ball portion 108 to provide a clearance to accommodate reception of a mated building element. In one example, the base 120 has a width 7.80 mm, a length 13.9 mm, and a thickness 0.87 mm.

The first portions 110 of the wall form a fin 122 in the y-z plane. The base 120 and fin 122 form a generally T-shape cross section, as viewed from the front or back as shown, for example, in FIG. 1B. The fin 122 is rounded and somewhat U shaped, as viewed from the side, for example, as shown in FIG. 1A.

A male, circular post or spine 130 extends from the center of the base 120 along the z axis, perpendicular to the base 120. The post 130 has a diameter of the first coupling size or 4.88 mm, such that the post is able to mate with a female recess of the first coupling size. The post 130 has a height 4.5 mm. The overall height of the waist construct element 101 from the base of the fin 122 to the top of the post 130 is 17.75 mm.

Figure 2B:
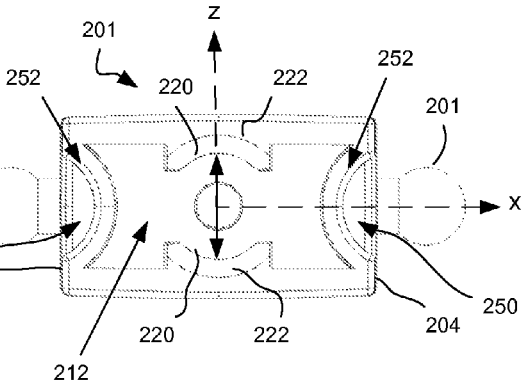
FIG. 2B is a bottom view of an exemplary torso construct element.
Figure 2C:
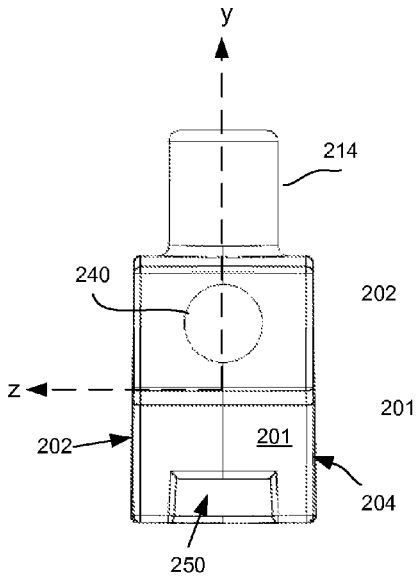
FIG. 2C is a side view of an exemplary torso construct element.
Figure 2D:
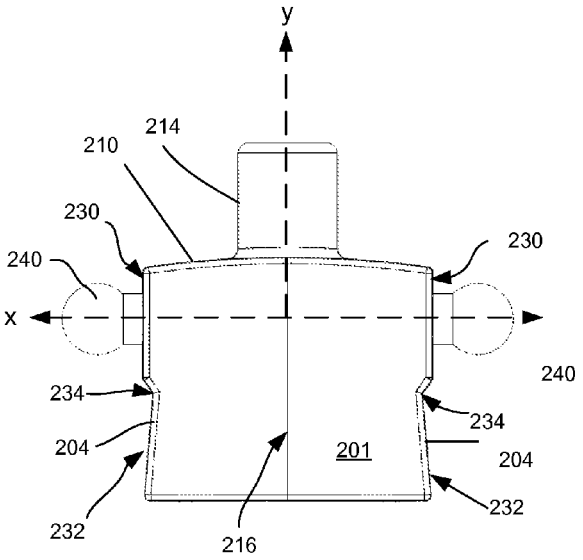
FIG. 2D is a front/back view of an exemplary torso construct element.
Figure 2E:
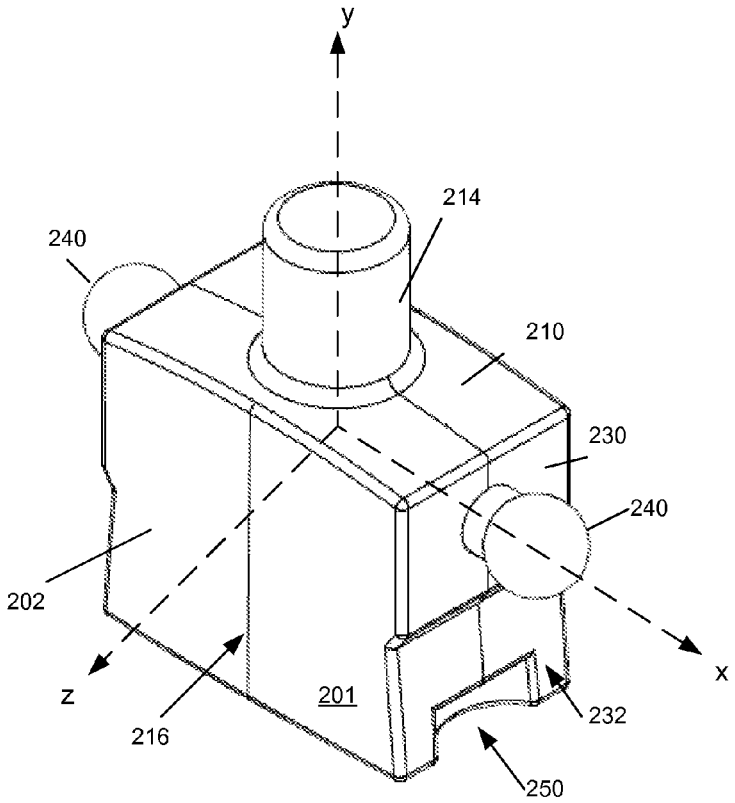
FIG. 2E is a first perspective view of an exemplary torso construct element.
Figure 2F:
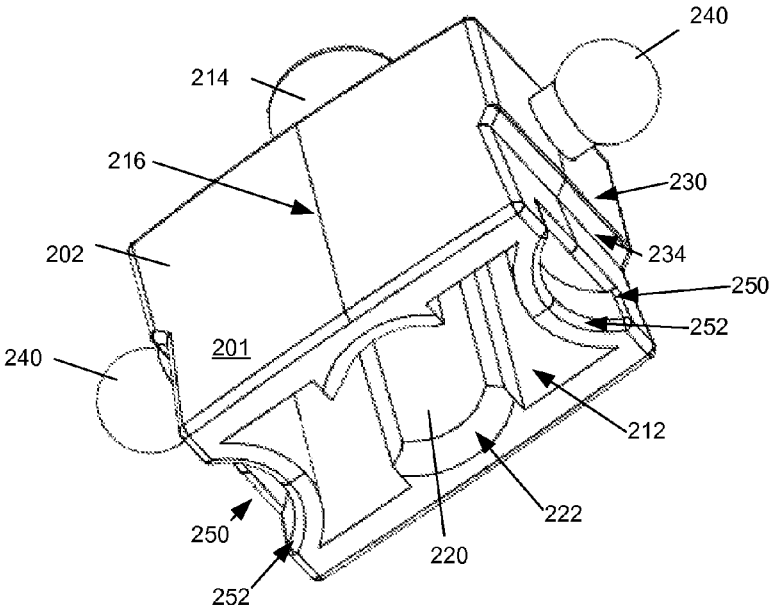
FIG. 2F is a second perspective view of an exemplary torso construct element.

FIGS. 2A-F show an example of a torso construct element 201. FIG. 2A is a top view of the torso construct element 201; FIG. 2B is a bottom view of the torso construct element 201; FIG. 2C is a side view of the torso construct element 201; FIG. 2D is a front/back view of the torso construct element 201; FIG. 2E is a first perspective view of the torso construct element 201; and FIG. 2F is a second perspective view of the torso construct element 201.

The torso construct element 201 is a partially symmetrical, three dimensional building element that may be constructed as unitary piece. As shown in FIGS. 2A-F, one half the torso construct element 201 mirrors the other half of the torso element 201 through the x-y and y-z planes. Generally, the corners and edges of the torso construct element 201 may be rounded. The torso construct element 201 is formed as a generally rectangular, box like element having five walls: two substantially co-planar walls 202 parallel to the x-y plane (for example, a front wall and a back wall); two contoured side walls 204 arranged opposite each other and generally parallel to the y-z plane; and a fifth wall 210 or top generally arranged orthogonal to the other four walls. The ends of four of the side walls 202, 204 frame an opening opposite the top wall 210 that provides access to a partially hollow, interior portion 212 of the torso construct element 201.

The top wall 210 is generally rectangular having dimensions 13.68 mm and 7.4 mm. A circular post 214 or neck extends longitudinally from the center of the outer surface of the top wall 210 along they axis and generally perpendicular to the top wall 210. The circular post 214 has dimensions that are the same as that of the post 130 of the waist construct element 101. The outer surface of the top wall 210 is slightly curved and slopes away from the post 214.

The front and back walls 202 of the torso construct element 201 are generally co-planar and the exterior surface of the wall may be slightly convex or bowed outwards from the interior along a centerline 216. A concave protrusion 220 extends from the interior surface of each of the front wall and the back wall. The protrusions 220 run the entire length along the center of the walls from the top to the bottom of the wall. The protrusions 220 run generally parallel to the y axis along the interior walls; however, the distance between the protrusions 220 slightly diminishes travelling along they axis from the open end of the torso construct element 201. Thus, the concave protrusions 220 are sized, shaped, formed so as to receive and engage a post element (for example, the neck post 130 or the spine post 214) when the post element is inserted into the hollow, interior portion of the torso construct element 201 through the open end and to provide a mechanical connection through an interference fit. In one example, the post meets increased resistance the deeper the post is inserted into the interior portion of the torso construct element 201. As a result, the torso construct element may be combined or mated with a waist construct element or another torso construct element, as described in further detail below. The bottom edges 222 of the protrusions may be slightly contoured inward so as to help guide or aid the insertion of a post into the interior portion and between the protrusions 220. Once two elements (for example, a torso construct element 201 and a waist construct element 101 or a torso construct element 201 and a torso construct element 201) are combined, the elements may rotate relative to each about the longitudinal axis of the post.

The outer surfaces of the two side walls 206, 208 include an upper portion 230 and a lower portion 232. The outer surfaces of the upper portion 230 of the side walls are generally coplanar to each other. Two shoulder joint elements 240 arranged on along the x axis extend outward from the upper portions 230 of the outer surfaces of the two side walls 206, 208. The joint elements 240 may be constructed as a stud and partial ball combination having the same dimensions and characteristics as the joint elements of the waist construct element.

The lower portion 232 of each of the exterior surface of the side walls (that is, at the open end away from the joint elements) angle slightly inward until reaching the upper portion 230 to create a slight notch 234. As a result, when viewed from the front or back, the notch 234 gives the appearance or definition of a chest or shoulder region of the torso. The lower portion 232 also includes two inward concave portions or cutouts 250. The cutouts 250 are shaped and formed to partially engage with a portion of the male stud of first coupling size of a common building element, such that one of the interior concave protrusions can seat on one male stud of a 1×2 standard building element with the wall 252 of a cutout portion 250 partially seating on the other male stud of the 1×2 standard building element.

Figure 3:
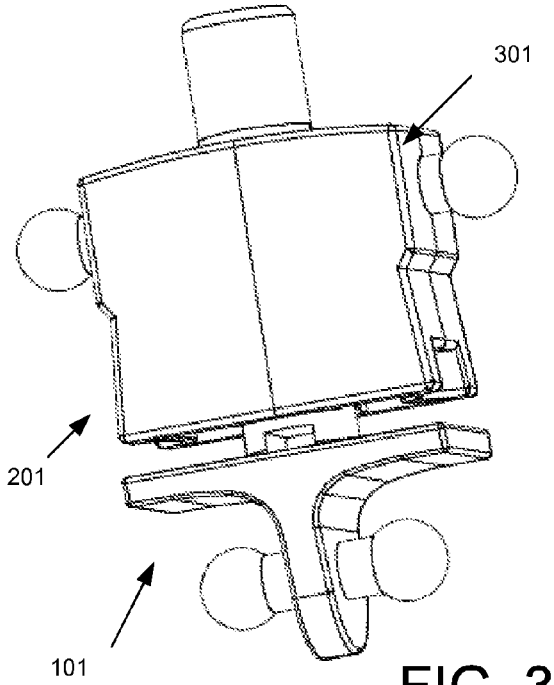
FIG. 3 is a perspective view of an exemplary trunk element of a small construct.

FIG. 3 is a perspective view of a trunk element 301 of a small construct. As shown in FIG. 3, the male post 130 of the waist construct element 101 is inserted into the hollow interior of the torso construct element 201 to mate with the concave interior protrusions 220 of the torso construct element to mechanically connect the waist construct element to the torso construct element via an interference fit to create a trunk element 301 of a small construct. The waist construct element 101 and the torso construct element 201 can be disassembled in the opposite manner by gripping and pulling the pieces apart. Additional build elements may be added to the trunk element 301 of a small construct. The waist construct element and the torso construct element may be independently rotated with respect to each other about the longitudinal axis of the post element.

Figure 4:
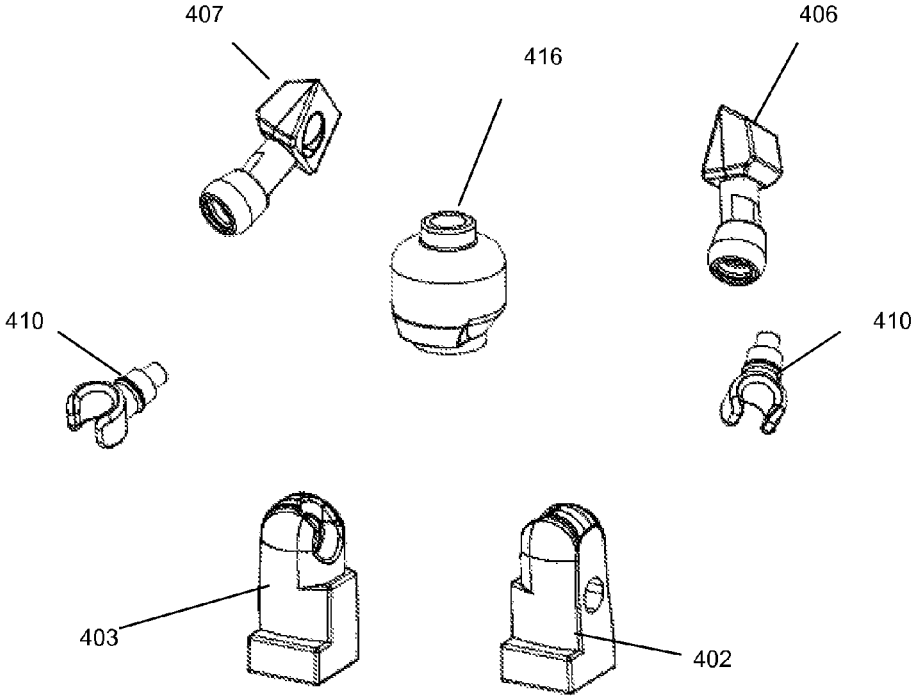
FIG. 4 is a perspective view of exemplary additional build elements that may be used to assemble a small construct.

FIG. 4 shows an example of additional building elements 401 that may be added to or combined with the trunk element 301 of a small construct to form the core element of a small construct. In this example, seven building elements are shown including two leg building elements 402, 403, two arm building elements 406, 407, two hand building elements 410, and a head element 416. The two leg building elements 402, 403 and the arm building elements 406, 407 can be mirror images of each other to provide, for example, a left building element 403, 407 and a right building element 402, 406. The building elements may be mechanically combined with the trunk element 301 of a small construct to assemble the core element of a small construct.

Figure 5A:
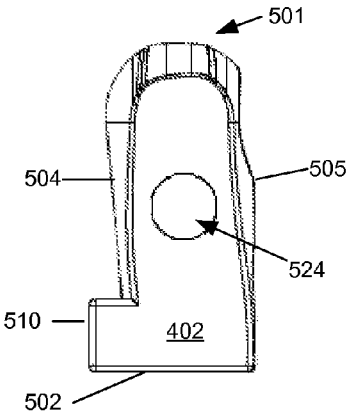
FIG. 5A is a exterior side view of an exemplary leg build element.
Figure 5B:
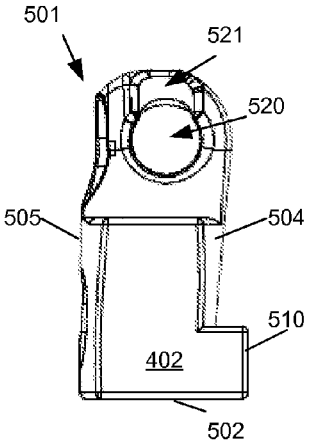
FIG. 5B is an interior side view of an exemplary leg build element.
Figure 5C:
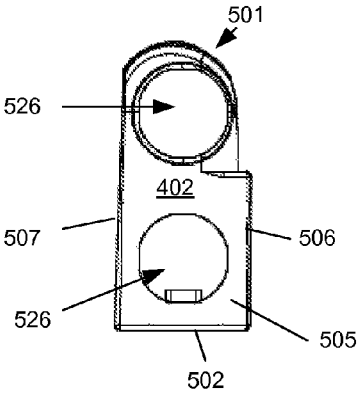
FIG. 5C is a back side view of an exemplary leg build element.
Figure 5D:
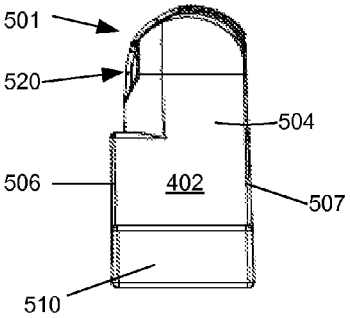
FIG. 5D is a front side view of an exemplary leg build element.
Figure 5E:
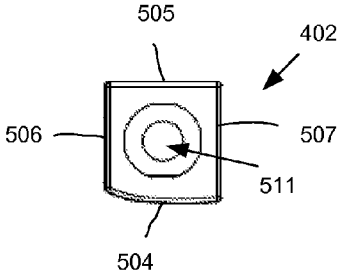
FIG. 5E is a bottom view of an exemplary leg build element.
Figure 5F:
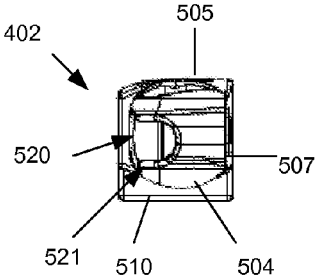
FIG. 5F is a topside view of an exemplary leg build element.

FIGS. 5A-E show one example of a leg building element 402. FIG. 5A is an exterior side view of the leg building element 402; FIG. 5B is an interior side view of the leg building element 402; FIG. 5C is a rear side view of the leg building element 402; FIG. 5D is a front side view of the leg building element 402; FIG. 5E is a bottom view of the leg building element 402; and FIG. 5F is a top view of the leg building element 402.

Each leg building element 402, 403 is an asymmetrical, three dimensional building element, which may be constructed as unitary piece. The leg building element 402 is generally a rectangular box like building element with a rounded hip end 501 and a flat foot end 502. The leg building element 402 includes four primary walls 504, 505, 506, 507 that end in the rounded proximal hip end 501 and define a foot 510 and hollow female recess 511 of the first coupling size at the distal end 502. The rounded end 501 includes a socket 520 sized to couple with the ball portion of a hip joint element 102 of the waist construct element 101 and a shoulder joint element 240 of the torso construct element 201 via a snap fit. To assemble the piece, a user pushes the socket 520 of the leg build element 402 against the ball portion of the joint to mechanically couple and lock together the elements with a snap fit to create a joint system. The socket 520 includes a U shaped cutout 521 that is substantially similar in width to the stud portion of the joint elements 102, 240 to provide an extra range of motion in certain orientations and positions. Once connected, the legs 402, 403 are able to partially rotate in three dimensions about the ball of the joint while remaining locked in the joint system. The joint system can be disassembled in the opposite manner by pulling the elements apart with sufficient force to separate the socket from the ball.

The outer side wall 507 includes a hole or bore 524 of a diameter of the second coupling size to accommodate rods or posts of the second coupling size. The rear face 505 of the leg building element 402 includes two female coupling elements or recesses 526 of the first coupling size. The center of the recesses are 8 mm apart so as to mate with the male stud coupling elements of a standard building element, such as a 1×2 plate or brick. The bottom of the front wall protrudes to form a foot 510 at the base of the leg. At the bottom of the foot is the female coupling element or recess 511 of the first coupling size to mate with the male stud coupling element of the first coupling size, such as a 1×1 plate or brick standard building element.

Figure 6A:
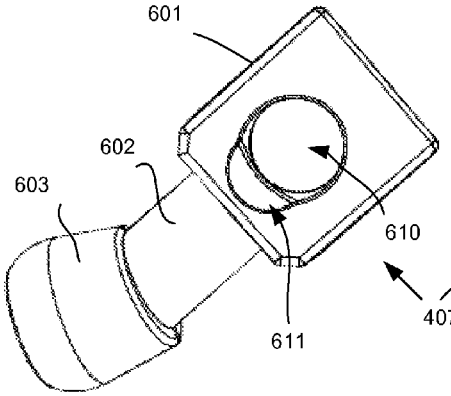
FIG. 6A is an interior side view of an exemplary arm build element.
Figure 6B:
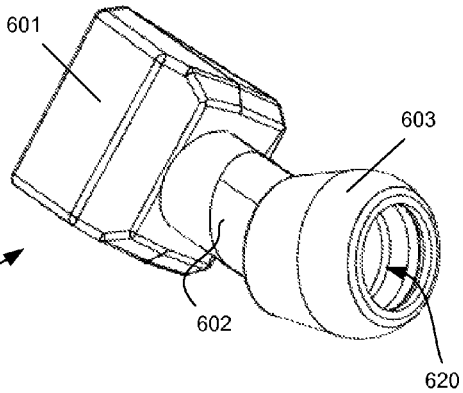
FIG. 6B is a perspective side view of an exemplary arm build element.

FIGS. 6A and B show one example of an arm building element 407. FIG. 6A is an interior side view of the arm building element 407 and FIG. 6B is a perspective view of the arm building element 407.

The two arm building elements 406, 407 can be mirror images of each other to provide a right and left arm. Each arm building element 406, 407 is an asymmetrical, three dimensional building element, which may be constructed as unitary piece. Each arm building element 406, 407 may include a shoulder 601, a narrow cylindrical portion 602, and a cuff 603.

A proximal end of the arm building element includes a shoulder 601. The shoulder 601 is larger than the cylindrical portion 602 and includes a socket 610 on an interior side. The socket 610 is sized to mate, couple, and lock with the ball portion of the joint element 102 of the waist construct element 101 or the joint element 240 of the torso construct element 201 using a snap fit to form a joint system. A user pushes the socket 610 against the ball portion of the joint to mechanically couple and lock the elements together with a snap fit. The joint system can be disassembled in the opposite manner by pulling the elements apart with sufficient force to separate the socket from the ball. Once connected to form a joint system, the arms 406, 407 are able to rotate in three dimensions about the ball while remaining locked in the joint system. The socket may include a small concave cutout 611 at the exterior edge of the socket 610 to aid positioning and movement of the arm building element 407 when attached to the torso construct element 201 or to the waist construct element 101.

The narrow cylindrical portion 602 extends between the shoulder 601 and the cuff 603. The narrow cylindrical portion 603 may have a diameter of the second coupling size, for example, 3.18 mm and a length of 4.42 mm allowing the hand building element 410, 411 (for example, of another small construct or core element) as well as by other types of gripping pieces included in construction toy kits to engage the cylindrical portion to mechanically couple with the narrow cylindrical portion 602 via a snap fit.

The cuff 603 includes a hollow cylindrical, female recess 620 arranged at the distal end of the arm building element 607. The recess 620 has a diameter sized to fit a male stud or post of the second coupling size. In particular, the hollow, cylindrical, female recess 620 is sized to receive the male stud of the hand building element 410.

Figure 7A:
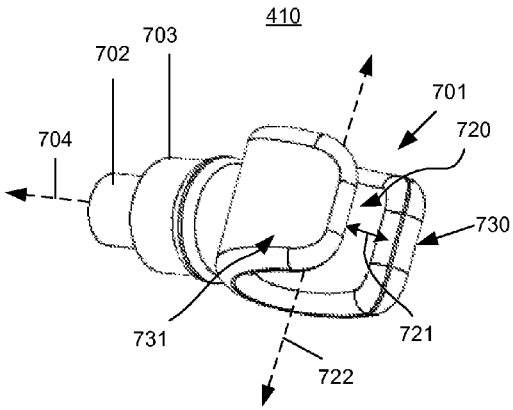
FIG. 7A is a first perspective view of an exemplary hand build element.
Figure 7B:
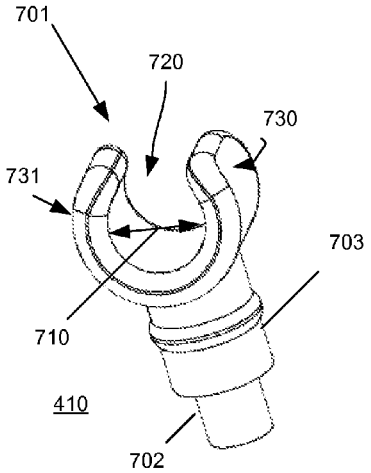
FIG. 7B is a second perspective view of an exemplary hand build element.

FIGS. 7A and 7B show an example of the hand building element 410. Each hand building element 410 is a partially symmetrical, three dimensional building element, which may be constructed as unitary piece. The hand build element 410 includes a C grip 701 and a male stud 702 of the second coupling size connected by a wrist 703. In this example, the male stud 702 of the hand building element 410 is inserted into the female recess 620 of the cuff 603 to mechanically couple the arm building element and hand building element 410 via an interference fit. The hand building element 410 may be rotated within the female recess 620 of the arm building element 607 around the center longitudinal axis 704 of the stud 702.

The C grip 701 generally forms the shape of a C when viewed from above or below and includes a generally cylindrical shape with a portion of one wall missing to form an opening 720 along the length of the cylinder providing access to a hollow, interior portion. The diameter of the hollow, interior 710 portion of cylinder is the same as the second coupling size and is formed to mate with a rod, handle, or other building element of the second coupling size using an interference fit. In one example, the diameter of the interior 710 is 3.18 mm. The width 721 of the opening 720 is 2.8 mm. Build elements may be inserted into the C grip 701 until a sufficient portion of the surface of the building element is inserted to establish the interference fit. The C grip 701 also may engage a rod having a diameter of the second coupling size by laying the rod against the opening 720 with the longitudinal axis of the rod aligned in parallel with the longitudinal axis 722 of the cylinder, and pressing the rod between the opening causing the sides 730, 731 of the cylinder to deform outward from the cylinder until the rod is seated in the hollow interior portion with a snap fit.

Figure 8A:
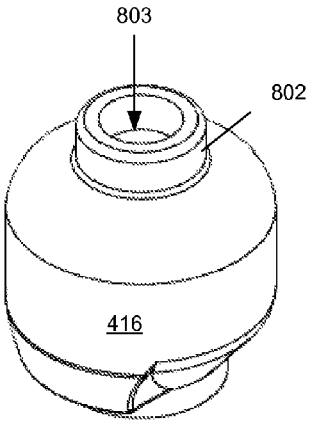
FIG. 8A is a first perspective view of an exemplary head build element.
Figure 8B:
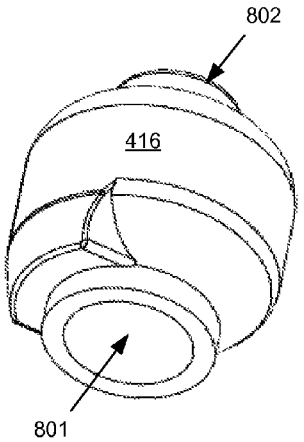
FIG. 8B is a second perspective view of an exemplary head build element.
Figure 8C:
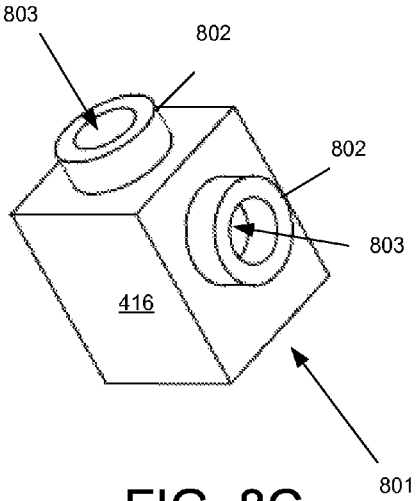
FIG. 8C is a perspective view of an exemplary head build element.

FIGS. 8A-8C show an example of a head building element 416. The head building element 416 is a three dimensional building element, which may be constructed as unitary piece. The head building element 416 is a generally cylindrical building element having a cored out center with an opening 801, and a cavity sized to receive the neck post 214 of the torso construct element 201 and can rotate when mounted to the post 214. The opening 801 at one end provides access to a bore or a hollow cylindrical, female recess of the first coupling size. In addition, a cylindrical male stud 802 protrudes from an end opposite the opening 801. The male stud 802 has an exterior diameter of the first coupling size and has a hollow interior portion or female recess 803 having a diameter of the second coupling size. Alternatively, the head building element 416 is generally a rectangular block with an additional male stud 802 with female recess 803 on a side face of the block in addition to the male stud 802 with female opening opposite the open end 801, as shown in FIG. 8C. The alternative head can be used in a build, such as a vehicle build that requires use of the head to attach parts to the head to create the small construct.

Figure 9D:
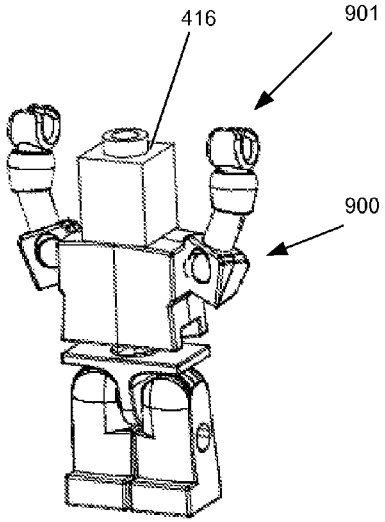
FIG. 9D is a perspective view of an assembled small figure of an exemplary small construct.
Figure 9A:
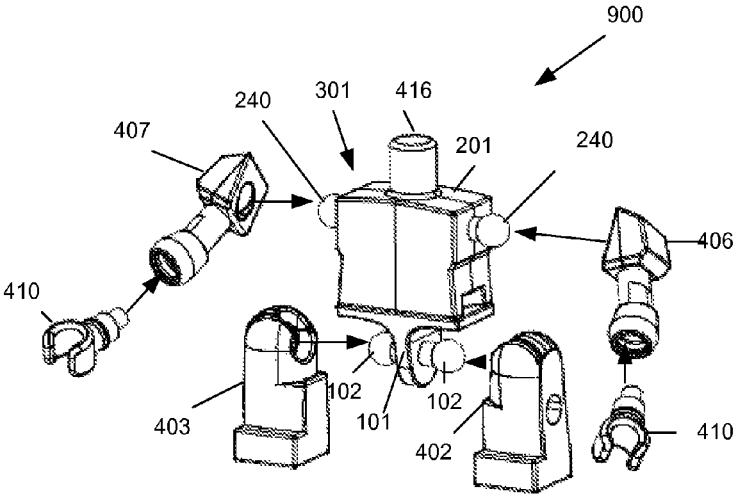
FIG. 9A is a partially exploded perspective view of the build elements being assembled to create a core of an exemplary small construct.
Figure 9B:
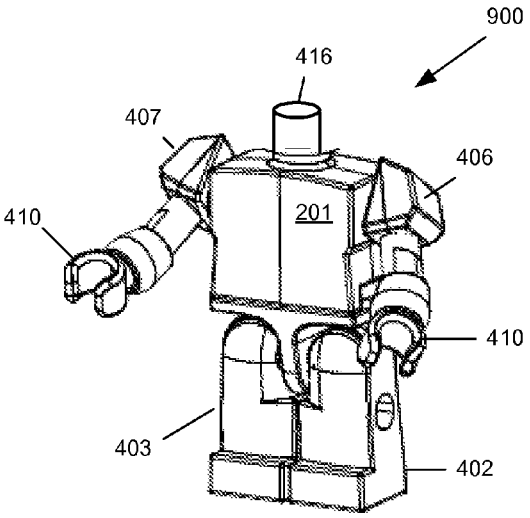
FIG. 9B is a perspective view of an assembled core of an exemplary small construct.
Figure 9C:
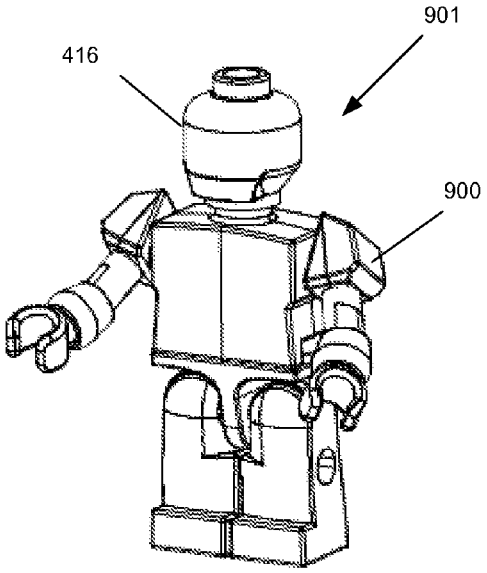
FIG. 9C is a perspective view of an assembled small figure of an exemplary small construct.

FIG. 9A shows an example of the construction of the core element 900 of a small construct from a trunk 301 and a number of building elements 402, 403, 406, 407, 410. Once the building elements 402, 403, 406, 407, 410 are connected to the trunk element 301, they form the core element 900 of the small construct as shown in FIG. 9B. All the building elements also can be disassembled in an opposite manner into their individual pieces (for example, 101, 201, 402, 403, 406, 407, and 410). A head building element 416 is attached to the core element 900 to create a small figure 901 of the small construct as shown in FIGS. 9C and 9D.

Additional parts and pieces may be added to the small figure 901 to create a particular build of a small construct. In one example, a build has at least two forms for a small construct including: a robotic build and a vehicular build. The robotic build has an overall humanoid, animal, extraterrestrial, or other appearance that has some resemblance to a living creature; while, the vehicular build resembles a craft providing some form of transportation, such as, for example, cars, trucks, construction vehicles, motorcycles, fixed wing aircraft, rotary aircraft, boats, ships, military vehicles, spacecraft, rockets, or imaginary hybrids or concepts of such vehicles. In addition, builds may be created to resemble fictional themes, crafts, characters, heroes, occupations, or real life vehicles and personalities, to name a few. For example, different builds may be formed to resemble or represent a group of fictional characters, such as the Transformers®. A set of parts are designated for a particular build; however, individual parts from the set for a specific build may be combined or intermingled with parts and constructs of different builds to create entirely new builds of the user's own creation or imagination.

Figure 10A:
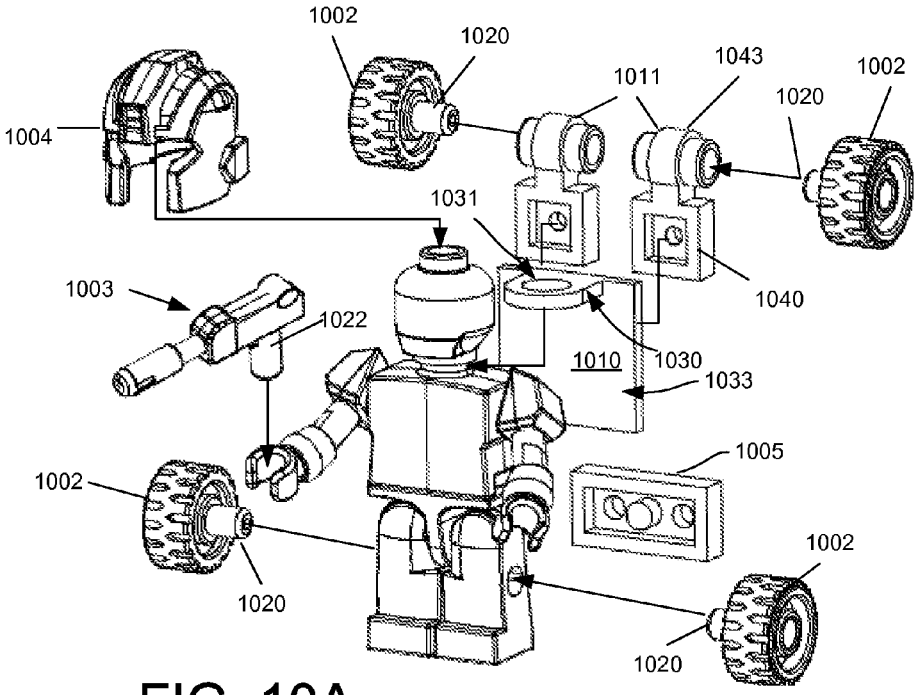
FIG. 10A is a partially exploded first perspective view of additional build elements being assembled to create a robotic build of an exemplary first small construct.
Figure 10B:
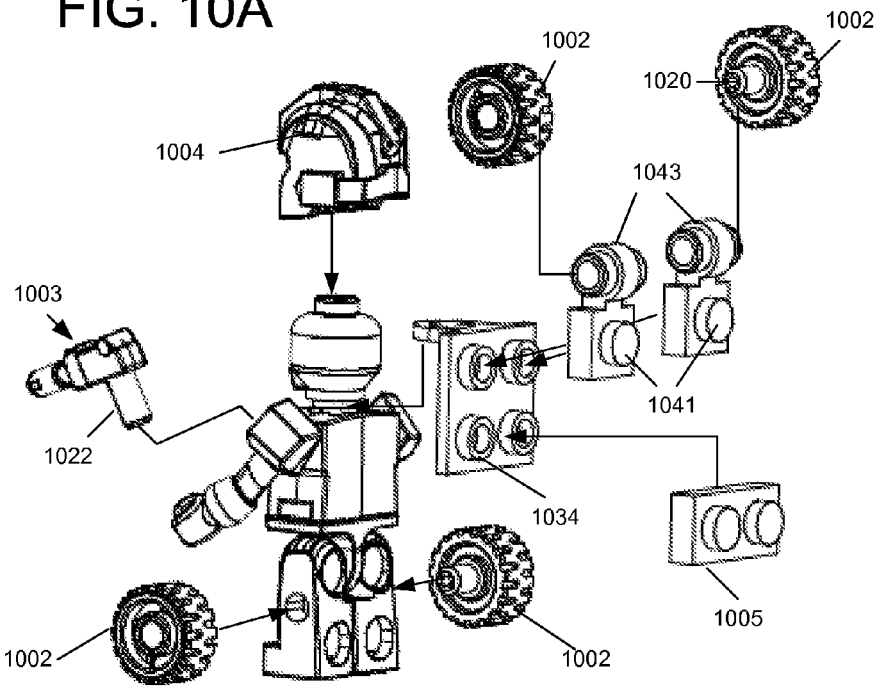
FIG. 10B is a partially exploded second perspective view of additional build elements being assembled to create a robotic build of an exemplary first small construct.
Figure 10C:
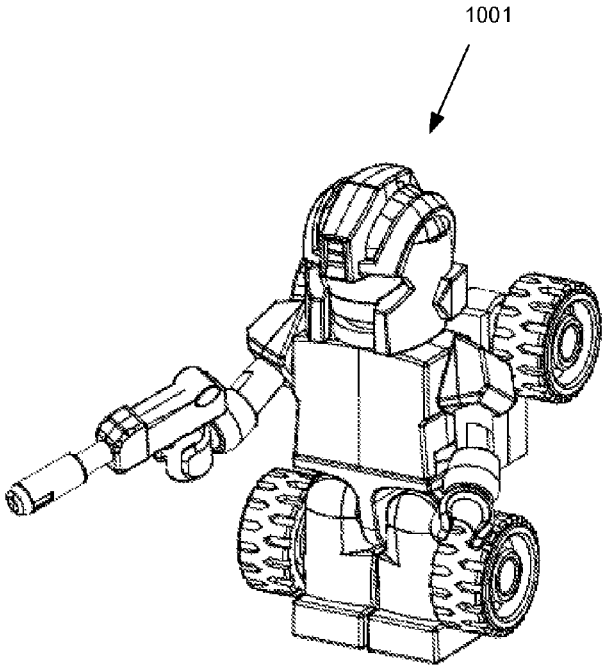
FIG. 10C is a perspective view of an assembled robotic build of an exemplary first small construct.

FIGS. 10A-10C show an example of a robotic build 1001 of a first small construct. FIGS. 10A and 10B are partially unassembled (or exploded) perspective views of the robotic build 1001 of a first small construct and FIG. 10C is an assembled perspective view of the robotic build 1001 of the first small construct.

As shown in FIGS. 10A-10C, the robotic build 1001 includes four tire parts 1002, a gun accessory 1003, a helmet accessory 1004, a 1×2 standard building plate 1005, a 90 degree adaptor 4×4 plate 1010, two 1×1 plate/axle hybrid parts 1011. The tire parts 1002 resemble vehicle tires and include a central post or axle 1020 of the second coupling size so that the axle 1020 mates with a female recess of the second coupling size, such as the bore hole 524 on exterior the leg build element or the axle part 1011. The gun accessory 1003 resembles a gun and has a rod handle 1022 of the second coupling size that can mate with a female recess of the second coupling size, such as the C grip 701 of the hand building element 410.

The 90 degree adaptor 4×4 plate 1010 includes a first portion 1030 and a second portion 1033 that are arranged in two planes orthogonal to each other. The first portion 1030 includes a hole 1031 of the first coupling size that can be placed over the neck post 214 or the waist spine 130 of the torso construction element 201 or the waist construction element 101, respectively, to allow building elements to stack on a second building axis orthogonal to a first building axis. The second portion 1033 includes a 4×4 plate having four male studs 1034 of the first coupling size. The two 1×1 plate axle parts 1011 include a first portion 1040 having a 1×1 plate having one male stud 1041 of the first coupling size and one female recess on the opposite side and a second portion 1043 having a hollow cylinder with an inner diameter of the second coupling size. The female recess parts of the two 1×1 plate axle parts 1011 can be connected to two corresponding male studs of the 4×4 plate 1010. The two female recess parts of the 1×2 plate 1005 can be placed on the remaining two corresponding male studs 1034 of the 4×4 plate 1010. The post or axle 1020 of a tire part 1002 can be inserted into each axle part 1011.

The helmet 1004 includes a hollow interior of width to be placed over the head building element 416. The helmet 1004 includes a female recess of the first coupling size that mates with the male stud 802 of the head building element 416 when placed on the head building element 416 to secure the helmet 1004 to the head building element 416 with an interference fit.

Figure 11A:
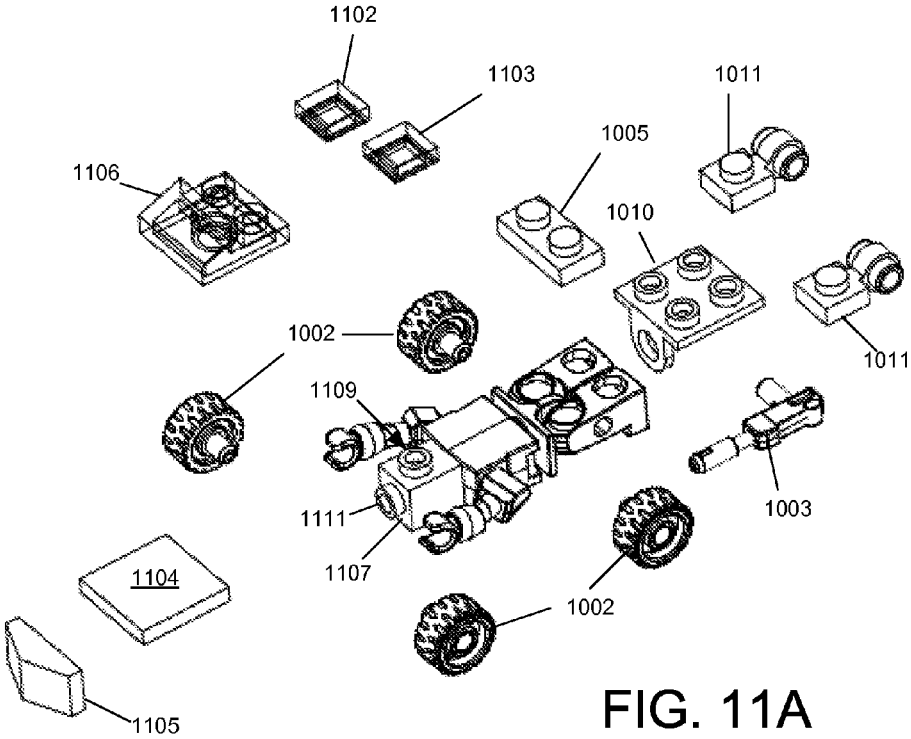
FIG. 11A is a partially exploded perspective view of additional build elements being assembled to create a vehicle build of an exemplary first small construct.
Figure 11B:
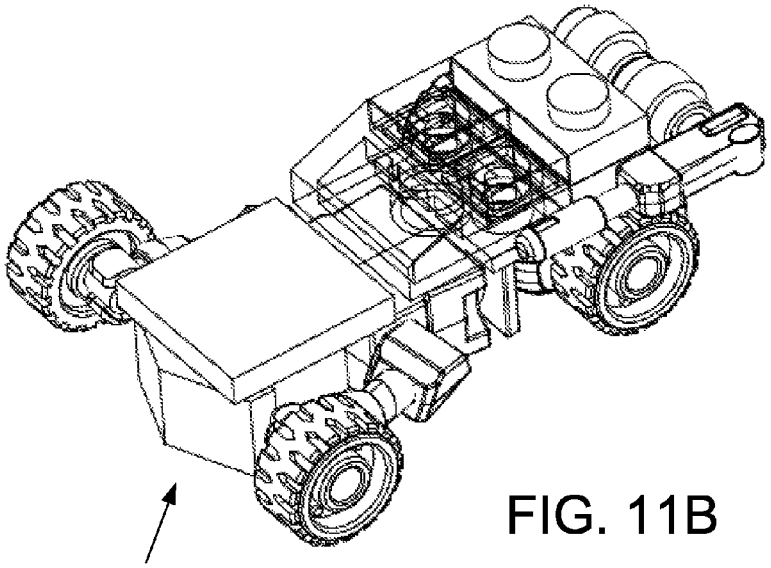
FIG. 11B is a first perspective view of an assembled vehicle build of an exemplary first small construct.
Figure 11C:
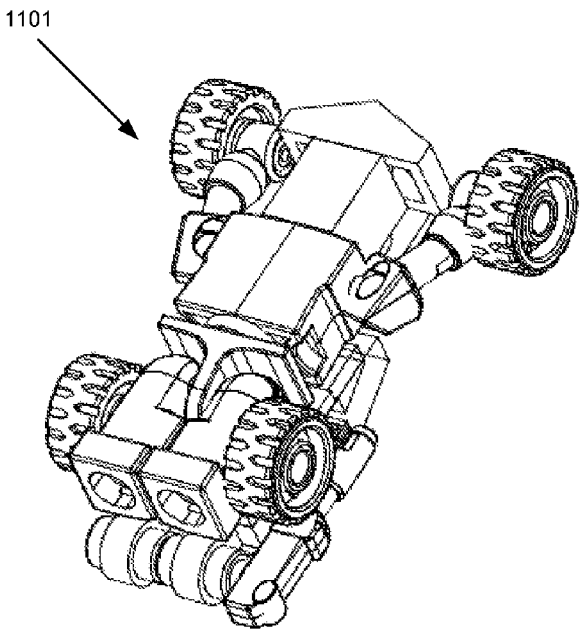
FIG. 11C is a second perspective view of an assembled vehicle build of an exemplary first small construct.

FIGS. 11A-11C show an example of a vehicle build 1101 of the first small construct. FIG. 11A shows an example of a partially unassembled (or exploded) perspective view of a vehicle build 1101 of the first small construct and FIGS. 11B and 11C show assembled perspective views of the vehicle build 1101 of the first small construct. In this example, the vehicle has the theme or aspects of a law enforcement vehicle. The vehicle build 1101 includes additional parts, such as a red clear 1×1 smooth plate 1102, a blue clear 1×1 smooth plate 1103, a 4×4 smooth plate 1104 and two specialized pieces 1105 and 1106. In addition, the vehicle build 1101 includes a different head building element 1107 that is roughly the size of a 1×1 standard building block with a male stud 1109 on one side wall in addition to the male stud 1111 on top.

Figure 12A:
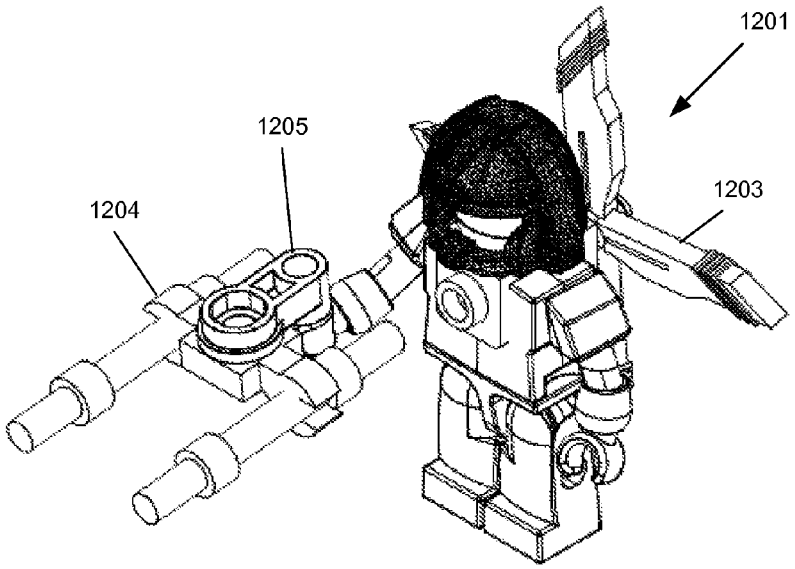
FIG. 12A is a perspective view of a robotic build of an exemplary second small construct.
Figure 12B:
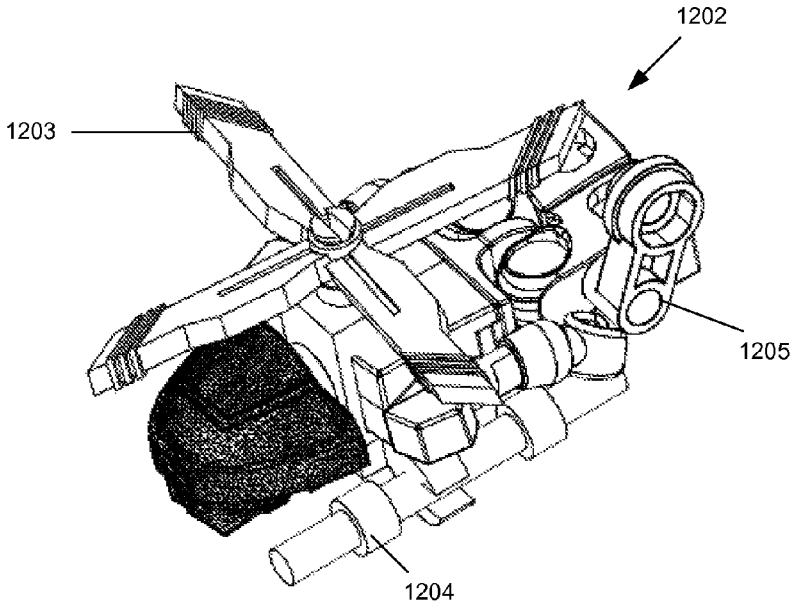
FIG. 12B is a perspective view of a corresponding vehicle build of an exemplary second small construct.
Figure 13A:
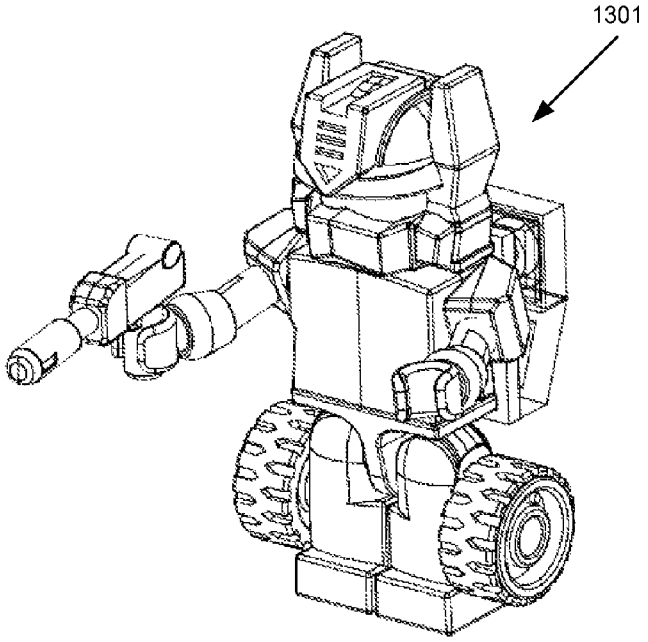
FIG. 13A is a perspective view of a robotic build of an exemplary third small construct.
Figure 13B:
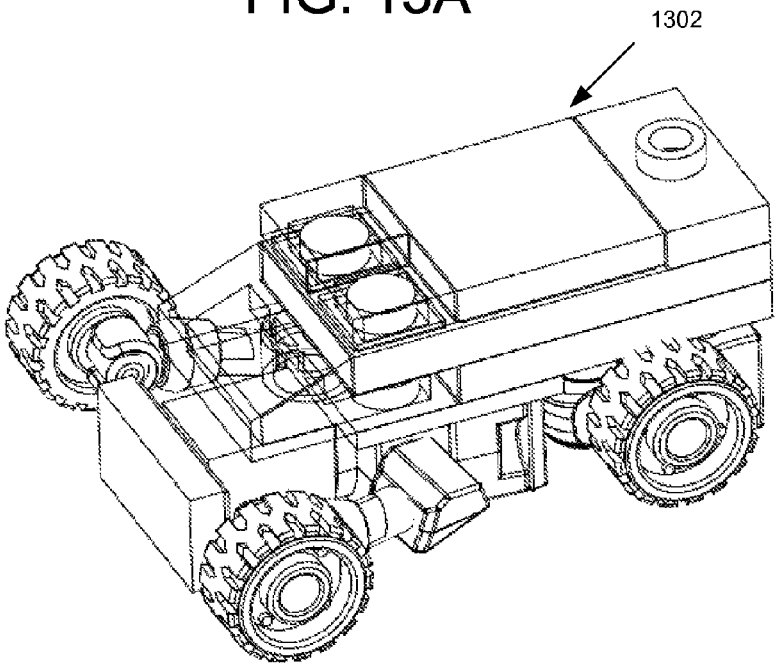
FIG. 13B is a perspective view of a corresponding vehicle build of an exemplary third small construct.
Figure 14A:
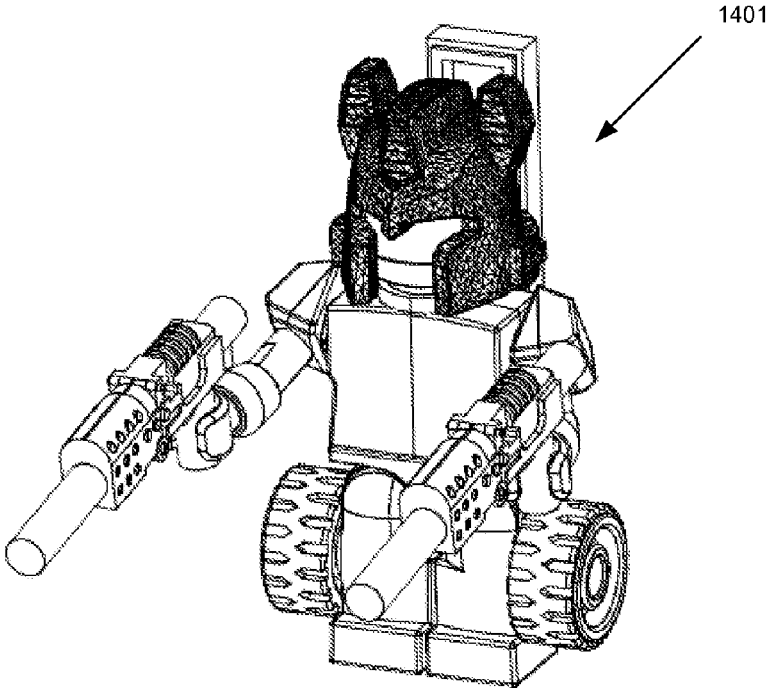
FIG. 14A is a perspective view of a robotic build of an exemplary fourth small construct.
Figure 14B:
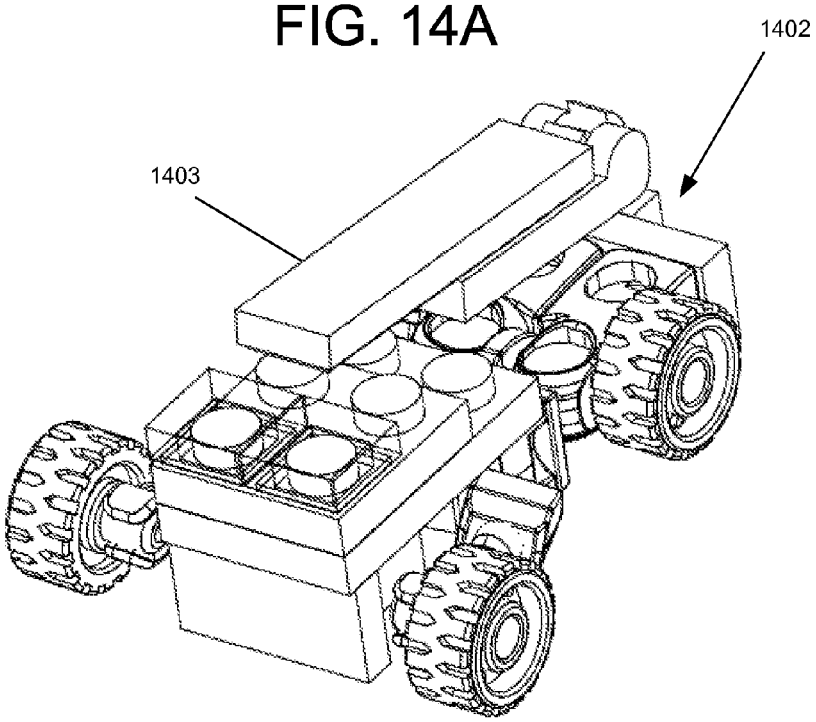
FIG. 14B is a perspective view of a corresponding vehicle build an exemplary fourth small construct.

FIGS. 12-14 show additional examples of builds for small constructs. FIG. 12A shows an example of a robotic build 1201 for a second small construct and FIG. 12B shows an example of a vehicle build 1202 for a second small construct. In this example, the vehicle has aspects of a helicopter and includes different specialized parts, such as rotor blades 1203, double barreled gun accessory 1204, and a tail rotor 1205, in addition to other parts. FIG. 13A shows an example of a robotic build 1301 for a third small construct and FIG. 13B shows an example of a vehicle build 1302 for a third small construct. In this example, the vehicle has aspects of an ambulance. FIG. 14A shows an example of a robotic build 1401 for a fourth small construct and FIG. 14B shows an example of a vehicle build 1402 for a fourth small construct. In this example the vehicle has aspects of a fire truck with a special hook n ladder part 1403.

One disadvantage of small constructs is that the building elements are limited in their ability to be assembled and scaled up into larger constructs having a similar shape and feel to the small constructs. Given the popularity of transforming toy action figures, it would be desirable to be able to create larger constructs that have a similar scalability and theme as a small construct. Generally, a problem arises when trying to create a construct of a larger scale with a similar shape and abilities as a small construct due to the specialized nature of the limbs (for example, the arm building elements and leg building elements) of the small construct. These limbs do not easily lend themselves in size and configuration for scaling up for use as limbs in larger constructs. However, according to the exemplary implementations described herein, multiple small constructs can be scaled up and assembled to form a large construct using a large construct combiner set. The combiner set includes minimal extra specialized and standard parts and/or building elements with little additional cost. In addition, the combiner set allows the small constructs to be assembled as a large construct while maintaining aesthetically pleasing proportions and scaling from a small figure to a large figure. In particular, multiple small figures 901 and their core elements 900 of the small constructs may be assembled into a large figure of a large construct with the use of additional special connectors or a special connector assembly, as described in further detail below.

FIGS. 15A-15F show an example of a first special connector 1501. FIGS. 16A-F show an example of a second special connector 1601. In addition, the first special connector 1501 and the second special connector 1601 may be combined in multiple orientations to form a hinged special connector assembly or combiner assembly 1701, as shown in FIGS. 17, 18, and 19. The combiner assemblies 1701 are used to combine multiple small constructs sets to create a large construct, as explained in further detail below.

Figure 15A:
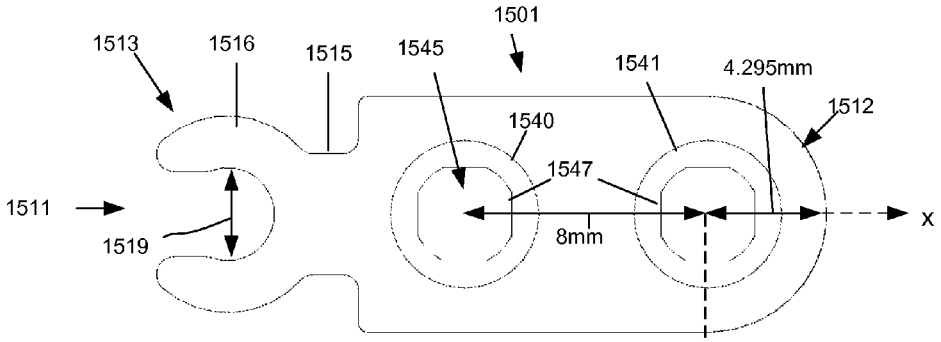
FIG. 15A is a top view of an exemplary first special connector.
Figure 15B:
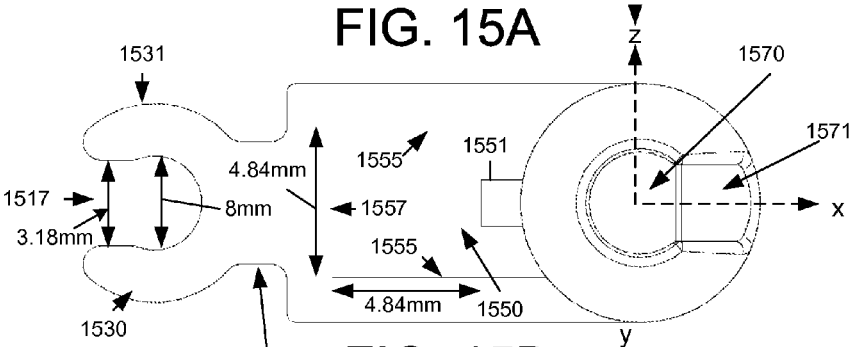
FIG. 15B is a bottom view of an exemplary first special connector.
Figure 15C:
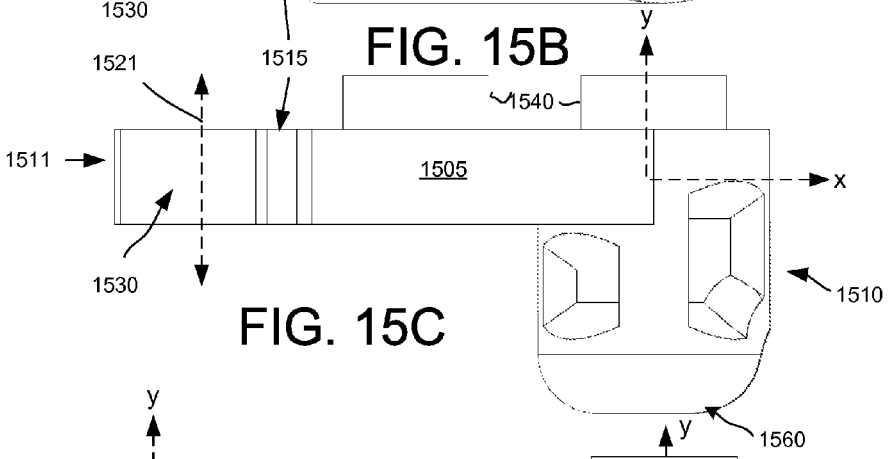
FIG. 15C is a side view of an exemplary first special connector.
Figure 15D:
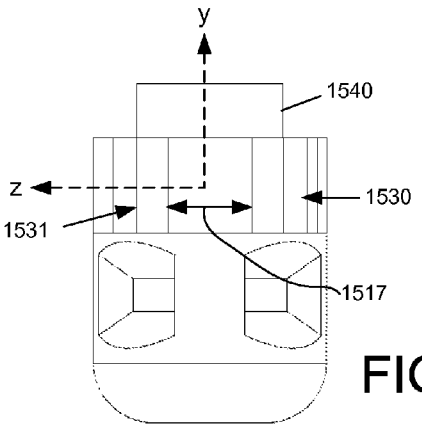
FIG. 15D is a back view of an exemplary first special connector.
Figure 15E:
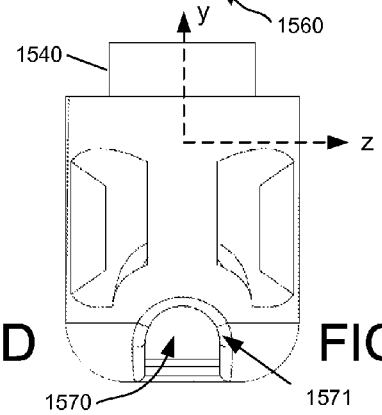
FIG. 15E is a front view of an exemplary first special connector.
Figure 15F:
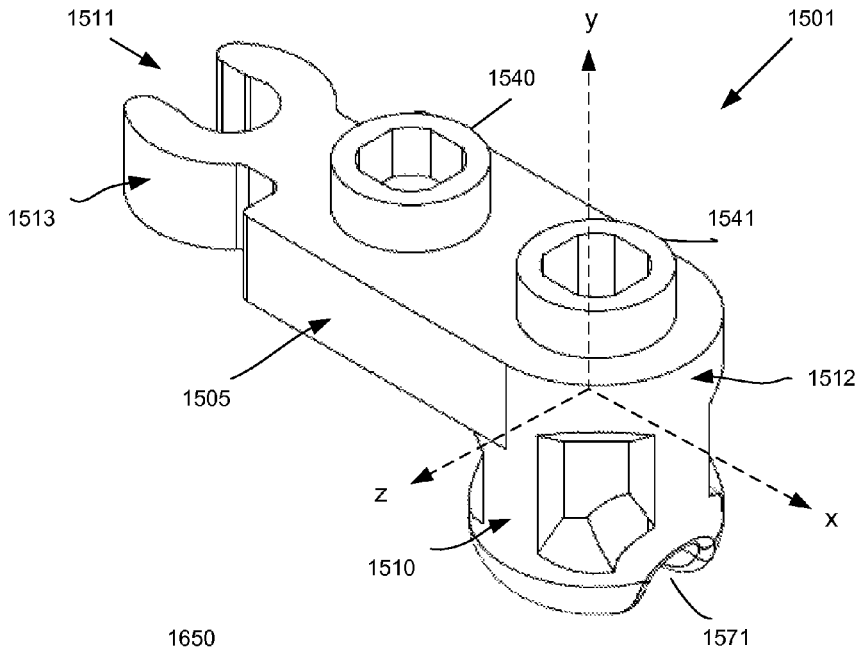
FIG. 15F is a perspective view of an exemplary first special connector.

FIG. 15A shows a top view of the first special connector 1501; FIG. 15B is a bottom view of the first special connector 1501; FIG. 15C is a side view of the first special connector 1501; FIG. 15D is a back view of the first special connector 1501; FIG. 15E is a front view of the first special connector 1501; and FIG. 15F is a perspective view of the first special connector 1501.

The first special connector 1501 is a partially symmetrical, three dimensional building element, which may be constructed as unitary piece. Half of the first special connector 1501 mirrors the other half of the first special connector 1501 when viewed through the x-y plane. The first special connector 1501 includes an arm portion 1505 and cylindrical portion 1510. The arm portion 1505 is formed generally in a first plane with the cylindrical portion 1510 extending orthogonally from one end of the first portion 1505.

The arm portion 1505 includes a first end 1511 and rounded end 1512. The first end 1511 includes a C grip 1513 that is formed by a narrower wrist portion 1515 combined with a C portion 1516 when viewed from above or below (for example, FIGS. 15A and 15B). The C portion 1516 includes a generally cylindrical shape with a portion of one wall missing to form an opening 1517 along the length of the cylinder providing access to a hollow, interior portion 1519. The diameter of the hollow, interior portion of cylinder is the same as the second coupling size. In one example, the diameter is 3.18 mm. The width of the opening 1517 is 2.8 mm. The C portion 1516 may engage a rod having a diameter of the second coupling size by laying the rod against the opening 1517 with the longitudinal axis of the rod aligned in parallel with the longitudinal axis 1521 of the cylinder, and pressing the rod between the opening causing the side walls 1530, 1531 of the cylinder to deform outward from the cylinder until the rod is seated between the sides 1530, 1531 in the hollow interior portion with a snap fit allowing the side walls 1530, 1531 to return to their original positions and lock the rod in place.

The top surface of the first special connector 1501 includes two male studs 1540, 1541 having an exterior diameter and height of the first coupling size. The male studs 1540, 1541 include a hollow female interior portion 1545 of the second coupling size. The interior portion 1545 includes two sets of flat sides 1547 arranged opposite each other at a distance of 3.08 mm with four rounded corners arranged in between having a diameter of 3.18 mm. One male/female stud 1541 is centered above the cylindrical portion, with the center of the stud 1541 formed at a radial distance of 4.295 mm from the rounded end 1512. The center of the second male/female stud 1540 is arranged 8.0 mm from the center of the first male/female 1541. In other words, the male studs 1540, 1541 are arranged to mate with standard building elements having female recesses of the first coupling size. The hollow, interior portion of the first male/female stud 1541 extends into the interior of the cylindrical portion.

The bottom surface of the arm portion includes a partially rectangular hollow area 1550 arranged to form a female recess compatible with a male stud of the first coupling size. A notch or stud 1551 extends from a sidewall of the cylindrical portion 1510 towards the opposite wall closer to the C grip end at a distance of 4.84 mm in the hollow interior portion. The other two interior walls 1553, 1555 of the hollow interior are arranged opposite each other at a distance of 4.84 mm and together with the wall 1557 and the notch 1551 create a female recess of the first coupling size.

The cylindrical portion 1510 extends orthogonally from the arm portion 1505 at the rounded end 1512 having an overall radius r that that is the same the radius of the curvature of the rounded end 1512 (that is, 4.295 mm). The diameter of the cylindrical portion 1510 is generally 7.8 mm. The combined height of the cylindrical portion 1510 and the thickness of the first portion are the same as the height of a standard brick building element (not including male stud) or 9.6 mm.

The end 1560 of the cylindrical portion 1510 opposite the arm portion 1505 is rounded or tapered. At the rounded end 1560 of the cylindrical portion 1510 is a circular opening centered on the longitudinal axis (for example, the y axis in FIG. 15) of the cylindrical portion to provide access to a hollow interior socket 1570. The hollow interior socket 1570 is sized to mate, couple, and lock with the ball portion 108 of the joint elements 102, 241 of the waist construct element 101 or the torso construct element 201, respectively, using a snap fit to form a joint system. A user pushes the socket 1570 against the ball portion 108 of the joint element with sufficient force to mechanically couple and lock the socket 1570 and the joint element 102, 241 together with a snap fit to form a joint system. The joint system can be disassembled in the opposite manner by pulling the elements apart with sufficient force to overcome the locking component of the snap fit and separate the socket 1570 from the ball. Once connected to form a joint system, the first special connector 1501 is able to rotate in three dimensions about the ball. The socket 1570 may include a small concave cutout 1571 at the exterior edge of the socket 1570 to aid positioning and movement of when attached to the torso construct element 201 or to the waist construct element 101. In one example, the cutout 1571 is U shaped having a width approximately the same the width of the shaft portion 106 of the joint elements 240, 102 of the torso construct element 201 and the waist construct element 101, respectively, and is formed on the outer wall of the cylindrical portion 1510 furthest from the C grip.

Figure 16F:
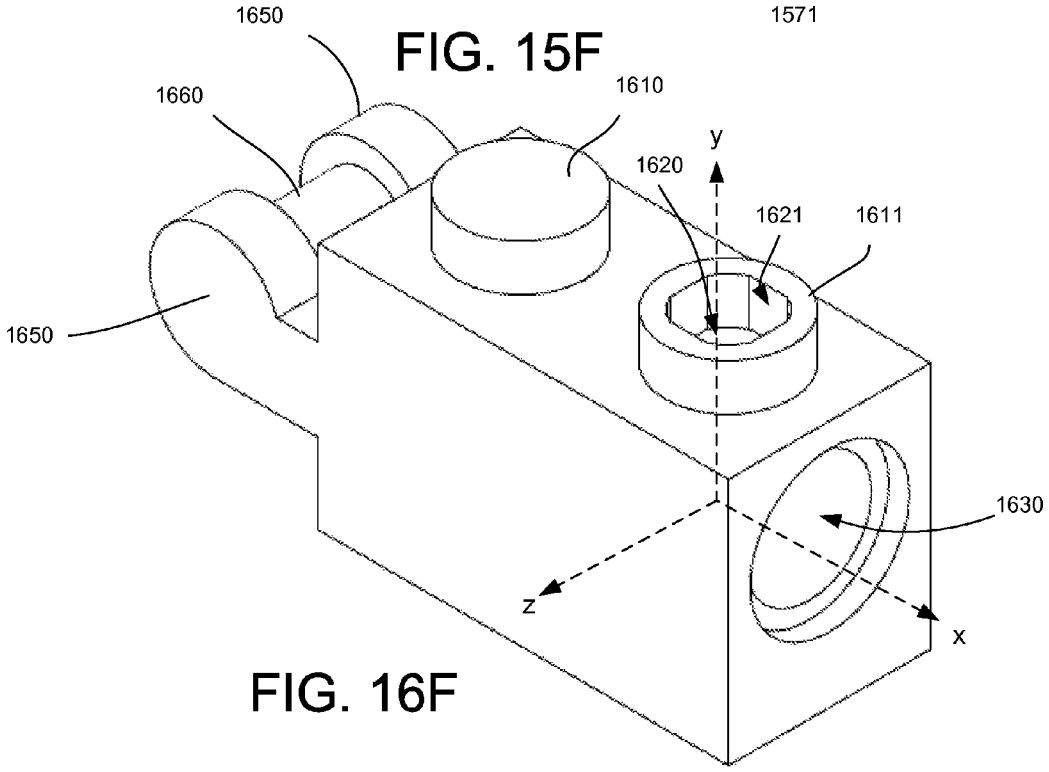
FIG. 16F is a perspective view of an exemplary second special connector.
Figure 16A:
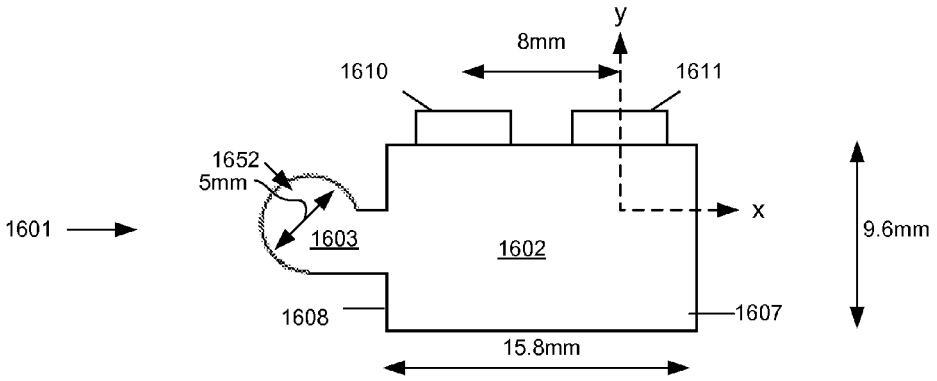
FIG. 16A is a side view of an exemplary special second connector.
Figure 16B:
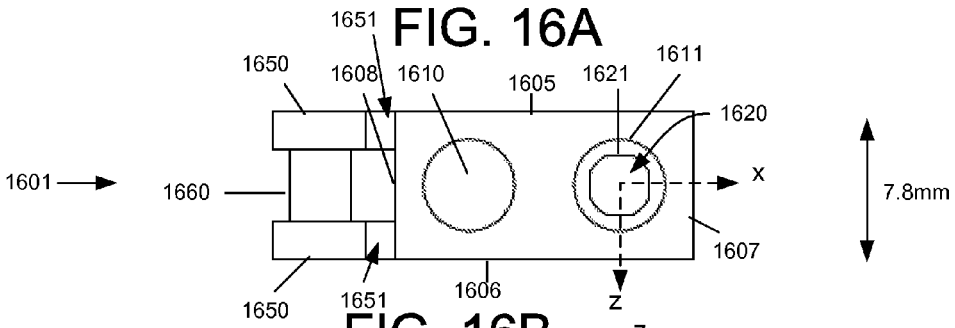
FIG. 16B is a top view of an exemplary special second connector.
Figure 16C:
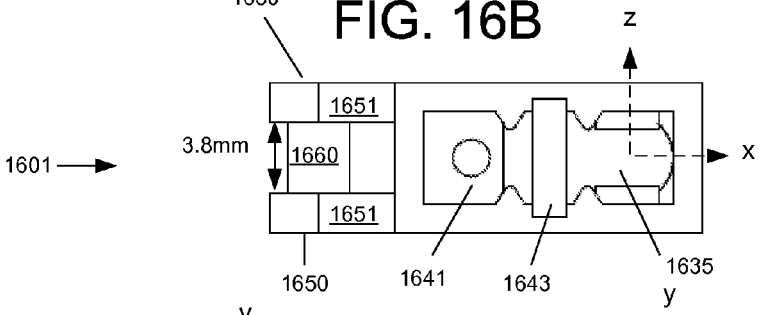
FIG. 16C is a bottom view of an exemplary special second connector.
Figure 16D:
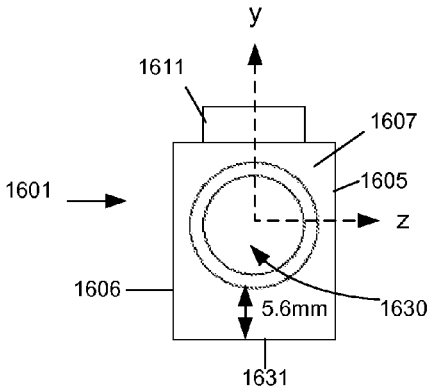
FIG. 16D is a front view of an exemplary special second connector.
Figure 16E:
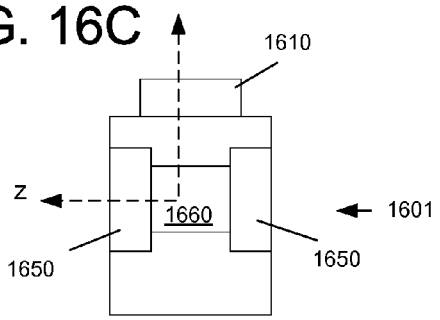
FIG. 16E is a back view of an exemplary special second connector.

FIGS. 16A-F show an example of the second special connector 1601. FIG. 16A is a side view of the second special connector 1601; FIG. 16B is a top view of the second special connector 1601; FIG. 16C is a bottom view of the second special connector 1601; FIG. 16D is a front view of the second special connector 1601; FIG. 16E is a back view of the second special connector 1601; and FIG. 16F is a perspective view of the second special connector 1601.

The second special connector 1601 is a partially symmetrical, three dimensional building element, which may be constructed as unitary piece. Half of the second special connector 1601 mirrors the other half of the second special connector 1601 when viewed through the x-y plane. The second special connector 1601 includes a rectangular block portion 1602 and a hinge portion 1603.

The rectangular block portion 1602 has two opposite, coplanar side walls 1605, 1606; two opposite, coplanar end side walls 1607, 1608, a top wall 1609 arranged in a plane orthogonal to other four side walls, and an open bottom framed by the four side walls 1605, 1606, 1607, and 1608. In general, the block portion 1602 has the dimensions and appearance of a standard 1×2 block building element. For example, the height of the block portion 1602 is 9.6 mm; the length of the block portion 1602 is 15.8 mm; and the thickness of the block portion 1602 is 7.8 mm. Two male studs 1610, 1611 of the first coupling size extend from the exterior surface of the top wall 1609. The centers of the studs 1610, 1611 are separated by a distance of 8 mm from each other. The centers of each of the studs 1610, 1611 are also arranged at a distance of 4.295 mm from three of the four side walls. The male stud 1611 furthest from the hinge portion 1603 includes a hollow female interior portion 1620 generally of the second coupling size. The interior portion 1620 includes two sets of flat sides 1621 arranged opposite each other at a distance of 3.08 mm with four rounded corners arranged in between having a diameter of 3.18 mm.

As shown in FIG. 16D, the end side wall 1607 opposite the hinged portion 1603 includes a hollow bore hole 1630 orthogonal to the exterior surface of the side wall 1607. The center of the bore hole 1630 is offset from the bottom edge 1631 of the wall 1607 to provide room for the female recess 1635 under the bore hole 1630 in the bottom of the block portion 1602 (described below), for example, at distance of the 5.6 mm from the bottom edge 1631 and centered between the other sidewall 1637, 1639. The bore hole 1630 has a size, shape, form so as to receive and engage a post element (for example, the neck post 214 of the torso construct element 201 or the spine post 130 of the waist construct element 101) when the post element is inserted into the bore hole 1630 to provide a mechanical connection through an interference fit.

The bottom of the rectangular block portion, as shown in FIG. 16C includes two female recesses 1635, 1641 of the second coupling size such that the recesses can mechanically couple with two male studs of the first coupling size of, for example, a 1×2 standard building element block or plate. One of the recesses 1641 is deeper than the other (because the bore hole wall blocks the other). In addition, there is a deep slot 1643 between the recesses.

The hinge portion 1603 extends from the end sidewall 1608 of the block portion 1602 opposite the side wall 1607 with bore hole 1630. Two coplanar generally P shaped members 1650 extend orthogonally from the plane created by the exterior surface of the end wall 1608. The stem portions 1651 of the Ps are essentially centered on the wall 1608 between the top wall 1609 and bottom of the block portion 1602 and extend from the end wall in the same plane as the coplanar sidewalls 1605, 1606. The circular portion 1652 of the P shaped member 1650 has a diameter of 5 mm. Extending between the center of the circular portions 1652 and orthogonal to the circular portions 1652 is a rod 1660 having a diameter of the second coupling size (for example, 3.18 mm) and a length slightly greater that the thickness of the C grip 1513 of the first special connector 1501 (for example, 3.8 mm), such that the rod 1660 can be engaged with the C grip 1513 of the first special connector 1501 to mechanically couple and lock the C grip 1513 to the rod via a snap fit to create a hinge joint system, as shown in FIGS. 17A-17D. In one example, the interior walls of the circular portion 1652 are of a larger diameter than the rod 1660 to help guide the C grip 1513 when coupling the C grip 1513 to the rod 1660. In addition, after the C grip 1513 and the rod 1660 are joined, the interior walls help smoothly guide movement of the C grip 1513 and the first special connector 1501 around the rod 1660 and provide some stability to the hinge joint system created.

The first special connector 1501 and the second special connector 1601 can be assembled to create a hinged joint assembly or a combiner assembly. FIG. 17A-D shows assembly of the first special connector 1501 and the second special connector 1601 to form a combiner assembly 1701 of a large construct.

Figure 17A:
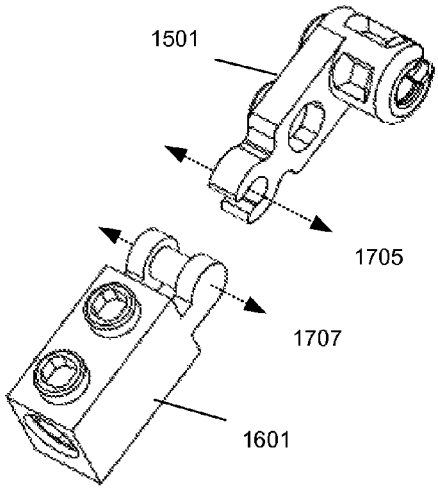
FIG. 17A is a perspective view of exemplary first and second connectors in a first orientation.
Figure 17B:
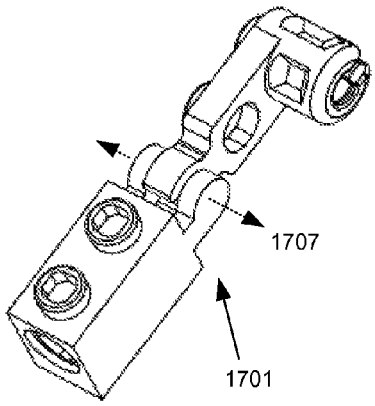
FIG. 17B is a perspective view of exemplary combiner element in a first orientation.
Figure 17C:
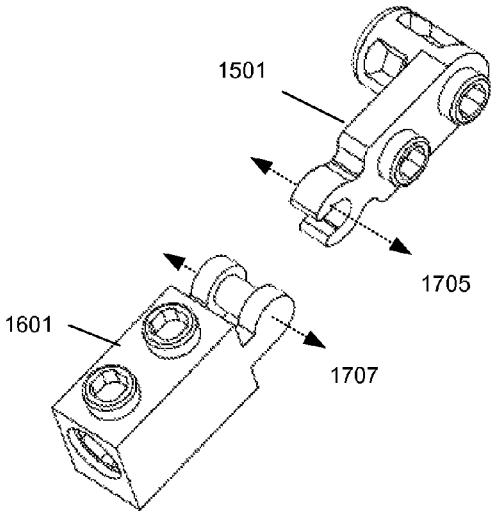
FIG. 17C is a perspective view of exemplary first and second connectors in a second orientation.
Figure 17D:
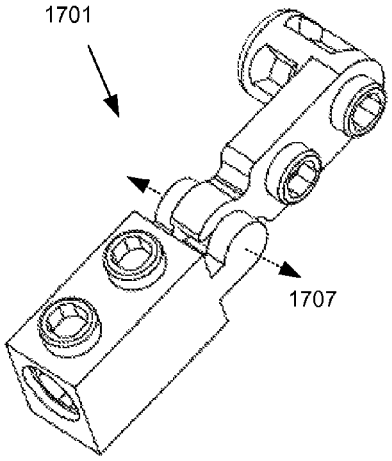
FIG. 17D is a perspective view of exemplary combiner element in a second orientation.

As shown in FIGS. 17A and 17B, the first special connector 1501 and the second special connector 1601 can be assembled to create a combiner assembly 1701 in a first orientation. As shown in FIGS. 17C and D, the first special connector 1501 and the second special connector 1601 can be assembled to create a combiner assembly 1701 in a second orientation. In the second orientation, the first special connector 1501 is turned 180 degrees about its longitudinal axis relative to its position in the first orientation.

As shown in FIGS. 17A-17D the C grip 1513 of the first special connector 1501 engages the rod 1660 of the second special connector 1601 to create a hinge joint system. The longitudinal axis 1705 of the opening in the cylinder formed by the C grip 1513 is aligned in parallel with the longitudinal axis 1707 of the rod 1660. After aligning, an end user forces the special connectors 1501, 1601 toward each other with sufficient force such that the rod 1606 passes through the opening of the C grip 1513 by temporarily deforming or displacing the side walls 1530 and 1531 of the cylinder of the C grip 1513 while the rod 1660 passes through the opening until the longitudinal axis 1707 of the rod 1660 coincides with the longitudinal axis 1705 of the hollow cylinder. As the rod 1660 is seated in the cylinder formed by the hollow interior portion of the C grip 1513, the walls 1530 1531 return to their original shape and/or position locking the rod 1660 within the C grip 1513 with a snap fit. Once connected, the C grip 1513 and rod 1660 form a hinged joint assembly system or combiner assembly 1701.

Once connected, the first special connector 1501 and the second special connector 1601 can move relative to each other by rotating in a plane orthogonal to the longitudinal axis 1707 of the rod 1660 with a little over a 180 degrees of movement within the rotational plane centered on the longitudinal axis 1707, as shown in FIGS. 18A-18E.

Figure 18A:
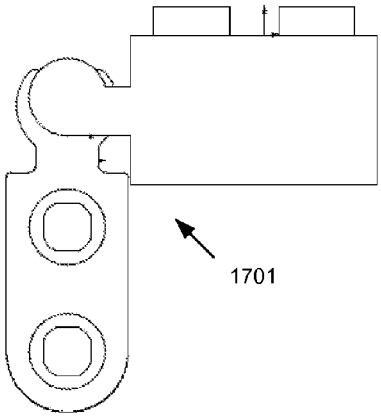
FIG. 18A is a side view of an exemplary combiner element in a first position.
Figure 18B:
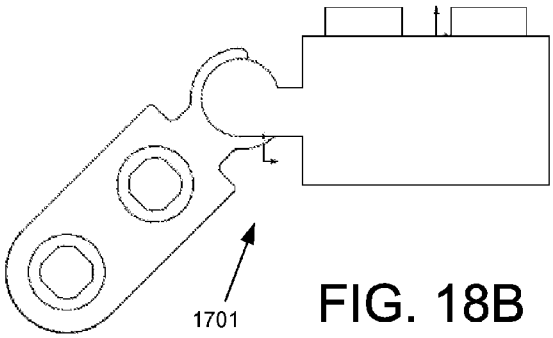
FIG. 18B is a side view of an exemplary combiner element in a second position.
Figure 18C:
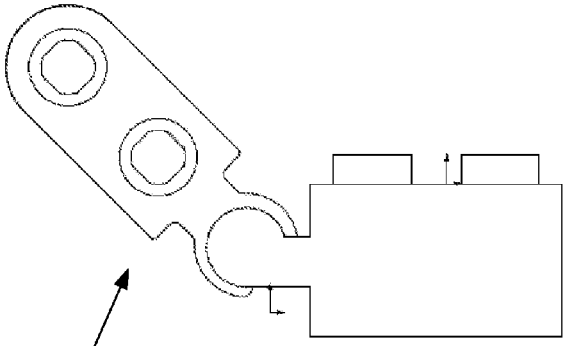
FIG. 18C is a side view of an exemplary combiner element in a third position.
Figure 18E:
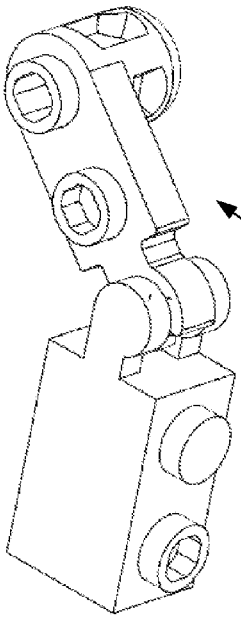
FIG. 18E is a perspective view of an exemplary combiner element in the second position.
Figure 18D:
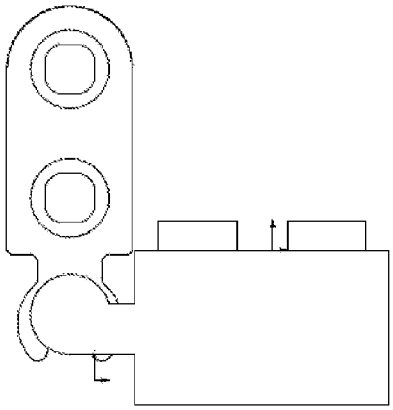
FIG. 18D is a side view of an exemplary combiner element in a fourth position.

FIGS. 18A-18E illustrate the movement of the first special connector 1501 relative to the second special connector 1601. Once locked to form a hinge assembly system, in the manner described above, the first special connector 1501 and the second special connector 1601 can move relative to each other by rotating in a plane around the longitudinal axis 1707 of the rod 1660 to any position desired by an end user with a little over a 180 degrees of movement within the rotational plane centered on the longitudinal axis 1707. FIG. 18A is a side view of an exemplary combiner assembly 1701 in a first position; FIG. 18B is a side view of the exemplary combiner assembly 1701 in a second position; FIG. 18C is a side view of the exemplary combiner assembly 1701 in a third position; FIG. 18D is a side view of the exemplary combiner assembly 1701 in a fourth position; and FIG. 18E is a perspective view of the exemplary combiner assembly 1701 in the second position.

Figure 19A:
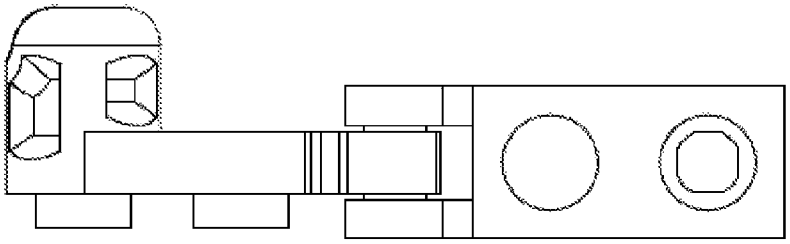
FIG. 19A is a top view of an exemplary combiner element for a large construct.
Figure 19B:
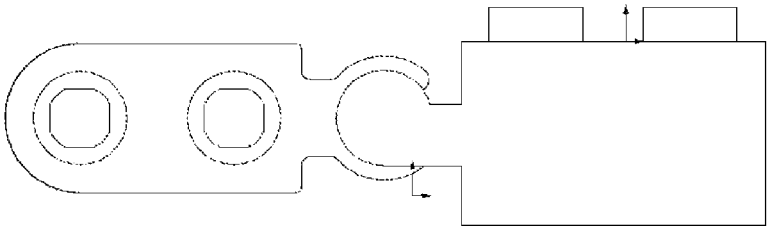
FIG. 19B is a first side view of an exemplary combiner element for a large construct.
Figure 19C:
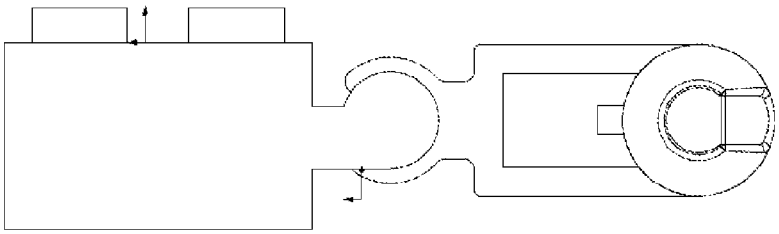
FIG. 19C is a second side view of an exemplary combiner element for a large construct.
Figure 19D:
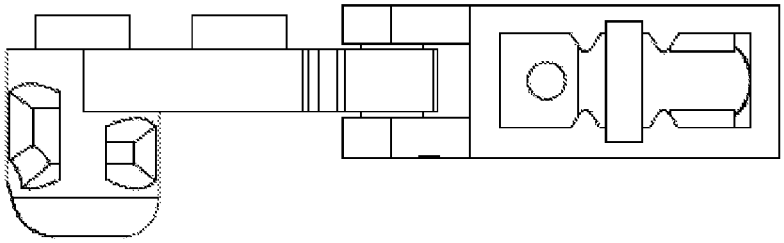
FIG. 19D is a bottom view of an exemplary combiner element for a large construct.
Figure 19G:
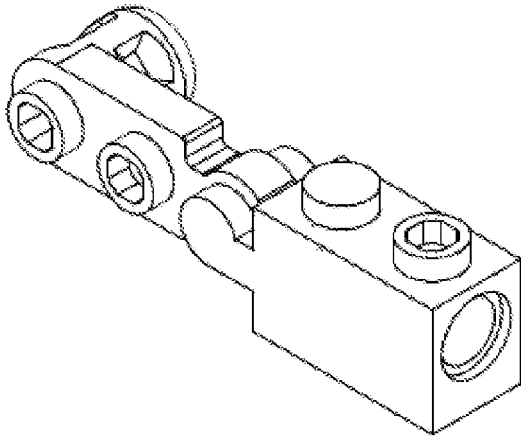
FIG. 19G is a perspective view of an exemplary combiner element for a large construct.
Figure 19E:
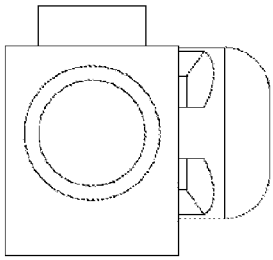
FIG. 19E is a front view of an exemplary combiner element r for a large construct.
Figure 19F:
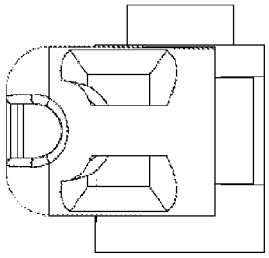
FIG. 19F is a back view of an exemplary combiner element for a large construct.

FIGS. 19A-19E show additional views of the exemplary combiner assembly 1701 for a large construct in the first orientation showing the relative orientation of the first special connector 1501 to the second special connector 1601 once connected to form the hinged joint. FIG. 19A is a top view of the combiner assembly 1701 for a large construct; FIG. 19B is a first side view of the combiner assembly 1701 for a large construct; FIG. 19C is a second side view of the combiner assembly 1701 for a large construct; FIG. 19D is a bottom view of the combiner assembly 1701 for a large construct; FIG. 19E is a front view of the combiner assembly 1701 for a large construct; FIG. 19F is a back view of the combiner assembly 1701 for a large construct; and FIG. 19G is a perspective view of the combiner assembly 1701 for a large construct. Once the first special connector 1501 and the second special connector 1601 are mechanically coupled in either orientation, the plane 1506 of the arm portion of the first special connector 1501 is orthogonal to the top wall 1609 of the second special connector 1601.

Figure 20:
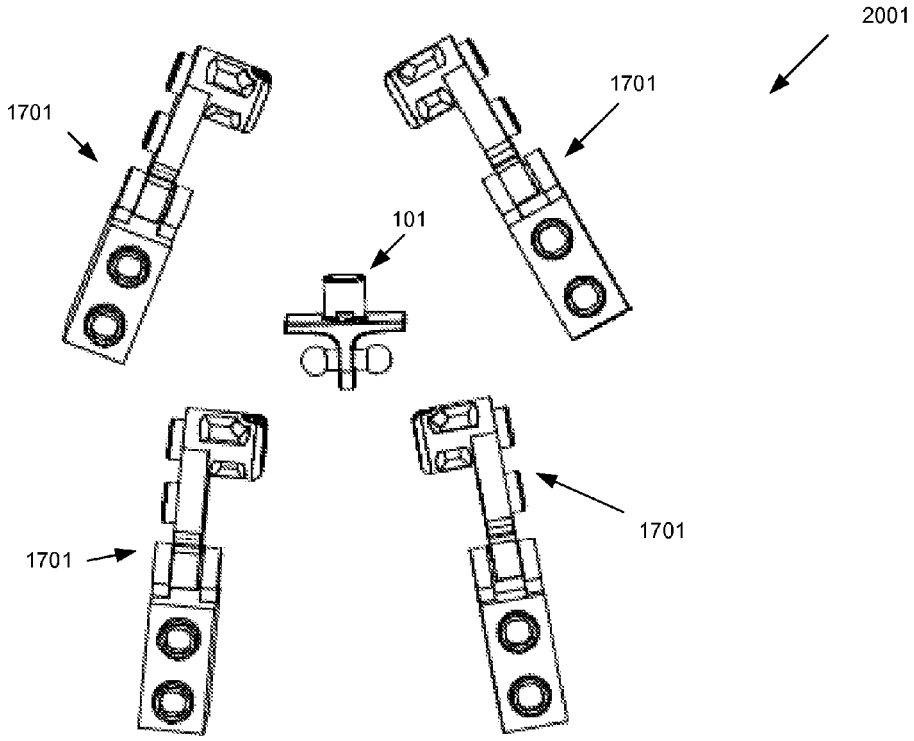
FIG. 20 is an exemplary combiner set for a large construct.

Multiple small constructs can be assembled to form a large construct using a large construct combiner set. FIG. 20 shows an example of five elements forming a construct combiner set 2001. The construct combiner set 2001 includes two construct combiner assemblies 1701 in the first orientation, two construct combiner assemblies 1701 in the second orientation, and a waist construct element 101. The construct combiner set 2001 is combined with multiple small constructs to create a large construct. In the following examples, four small constructs and a construct combiner set 2001 are used to create a large construct.

Figure 21:
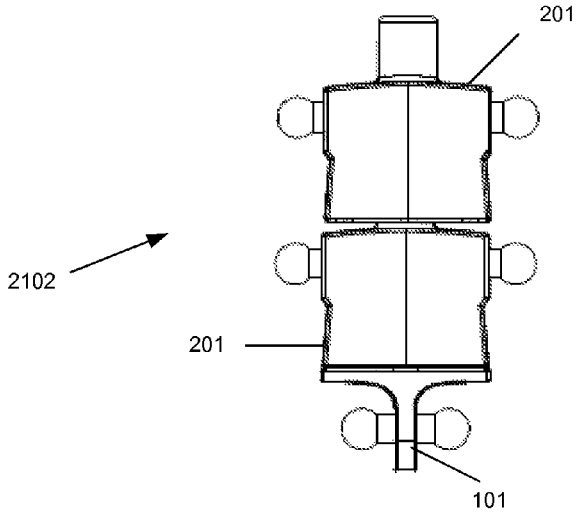
FIG. 21 is an exemplary trunk element of a large construct.

FIG. 21 shows an example of a trunk element 2102 of a large construct. The trunk element 2102 of the large construct is created by combining two torso construct elements 201 and a waist construct element 101. As shown, the neck post 214 of one torso construct element 201 of a small figure is inserted between the concave protrusions of the hollow portion of the torso construct element 201 of another small figure to mechanically combine the torso construct elements 201 with an interference fit. The spine post 130 of a waist construct element 101 is inserted between the concave protrusions of the hollow portion the lower torso construct element 201 to mechanically combine the waist construct element 101 and the torso construct element 201 with an interference fit. In one example, the one torso construct element 201 of a first small construct is combined with a torso construct element 201 of a second small construct and the waist construct element 101 of the combiner set to form the trunk element. Alternatively, the trunk element 301 of a small figure of the first construct may be mechanically combined with the torso construct element 201 of a second small construct to create the trunk element of the large construct.

Figure 22A:
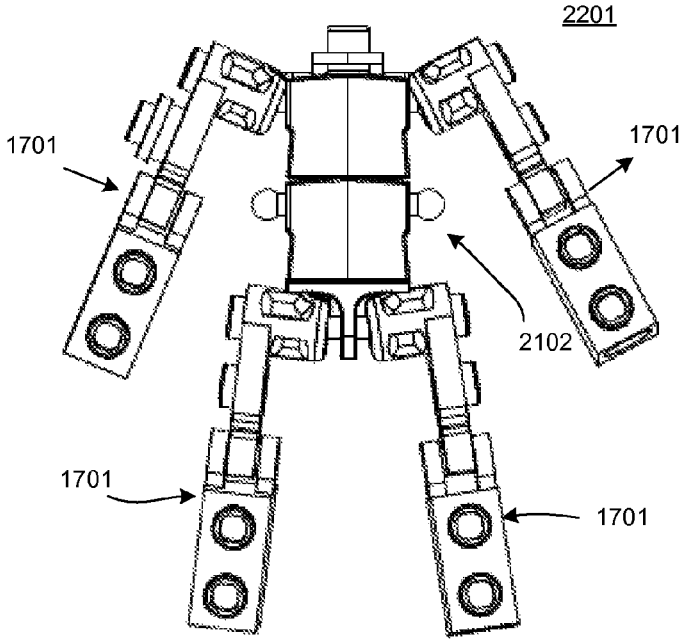
FIG. 22A is a front view of an exemplary an assembled combiner set and trunk element of a large construct.
Figure 22B:
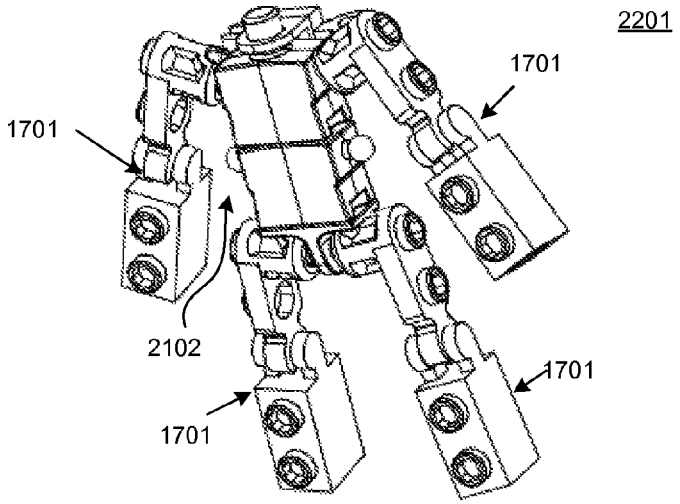
FIG. 22B is a perspective view of an exemplary an assembled combiner set and trunk element of a large construct.

FIGS. 22A and 22B show an example of a core element 2201 of a large construct. The core element 2201 of a large construct of includes four combiner assemblies 1701 attached to the trunk 2102 of a large construct. Two combiner assemblies 1701 of the first orientation are attached to joints on a first side of the trunk 2102, and two combiner assemblies 1701 of the second orientation are attached to joints of a second side of the trunk 2102. Two combiner assemblies 1701 of different orientations are attached to the joint elements 240 of the upper torso construct element 201 of the trunk 2102 of the large construct, and two combiner assemblies 1701 of different orientations are attached to the joint elements 101 of the waist construct element 101 of the trunk 2102 of the large construct.

Figure 23A:
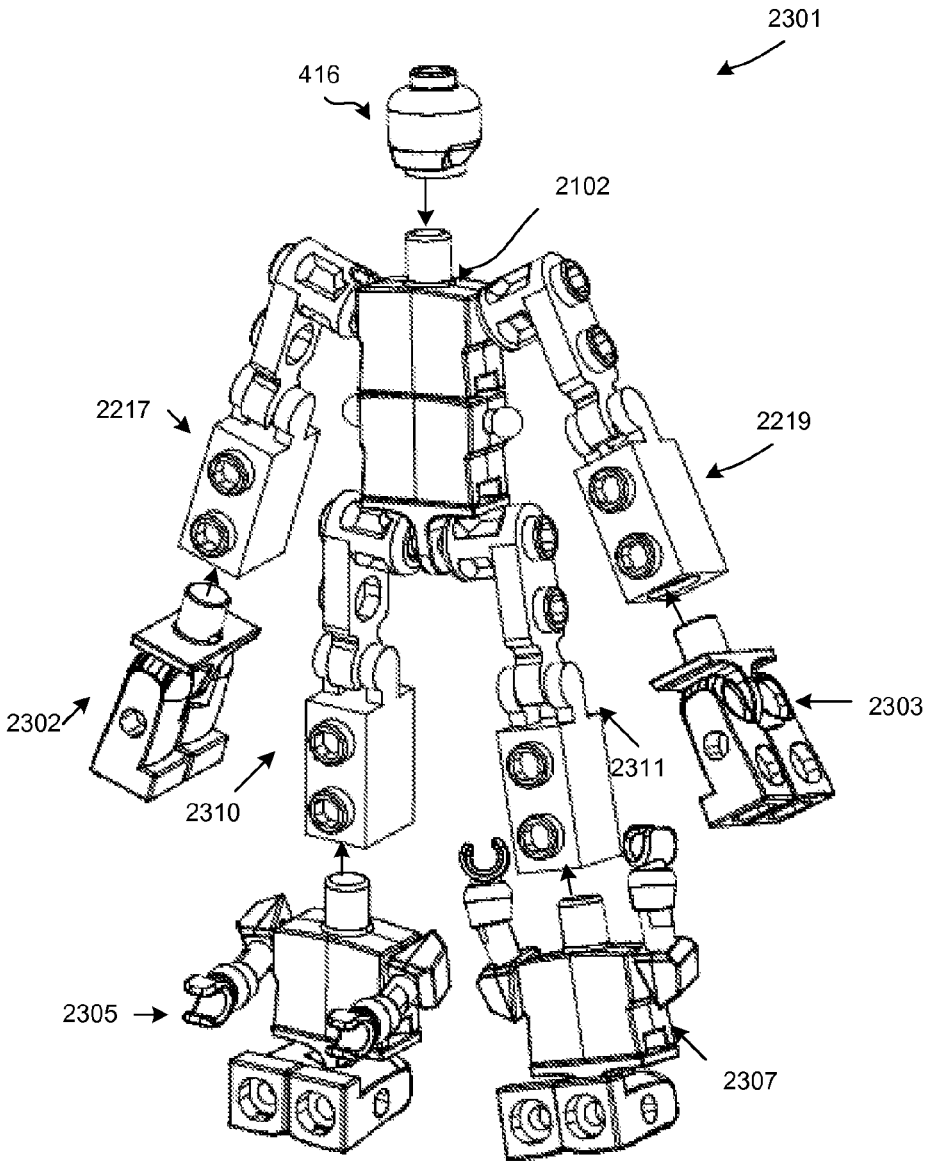
FIG. 23A is a partially exploded perspective view of the construction of an exemplary core element of a large construct.
Figure 23B:
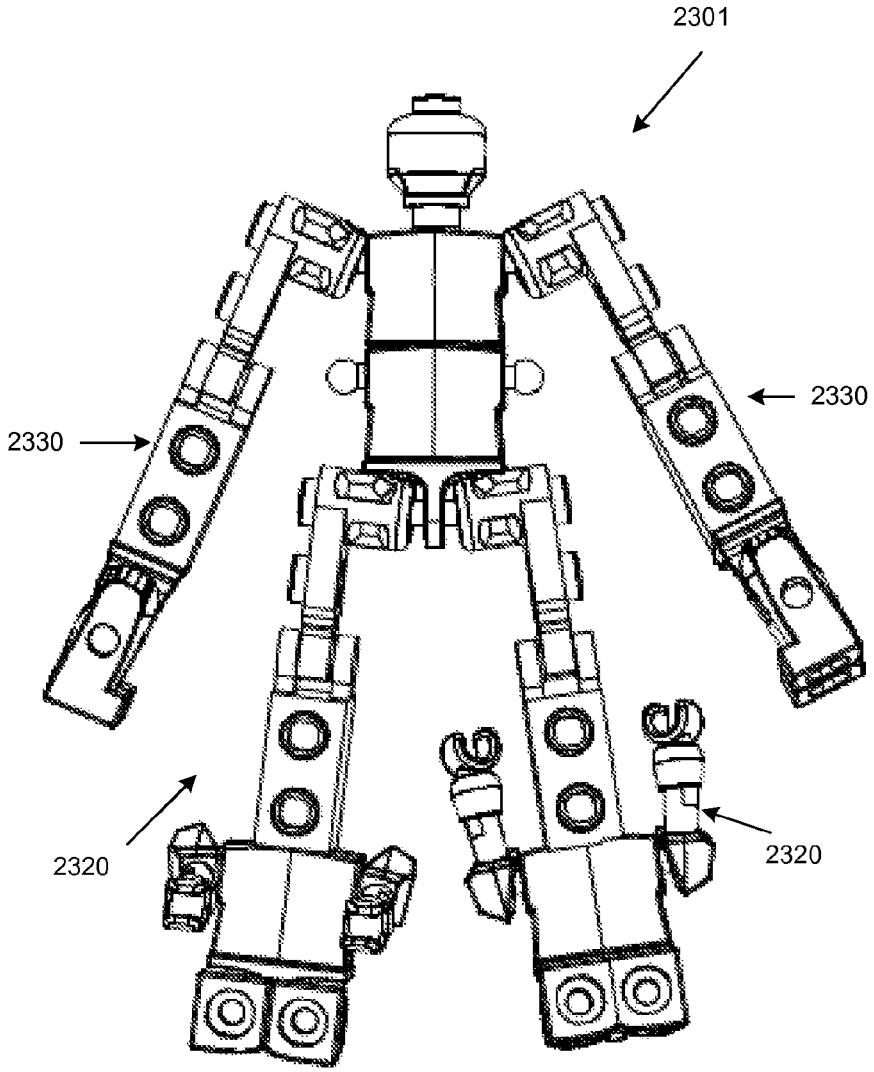
FIG. 23B is a front view of an assembled exemplary core element of a large construct.
Figure 23C:
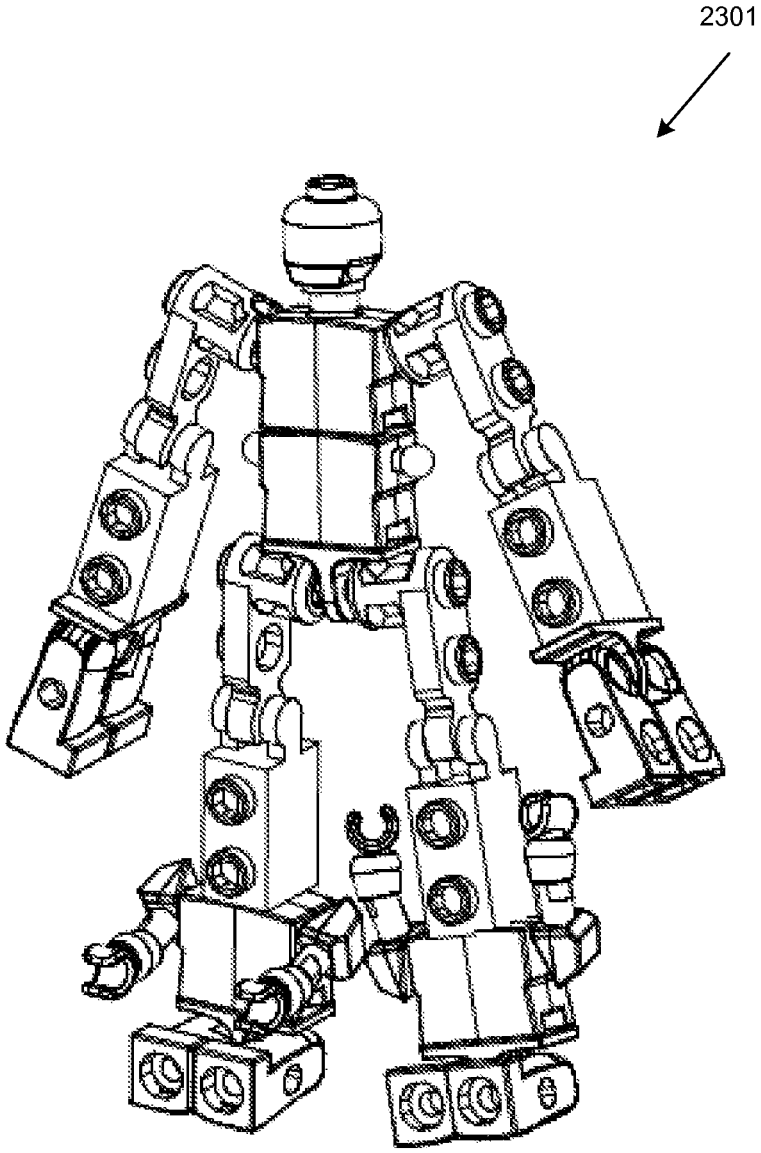
FIG. 23C is a perspective view of an assembled exemplary core element of a large construct.

FIGS. 23A-23C show an example of a large FIG. 2301 of a large construct. FIG. 23A is a partially exploded perspective view of the construction of the large FIG. 2301 of the large construct showing assembly of the figure; FIG. 23B is a front view of the assembled large FIG. 2301 of the large construct; and FIG. 23C is a perspective view of the assembled large FIG. 2301 of the large construct.

As shown in 23A, four core elements of four small constructs are used to create the large FIG. 2301 of the large construct. As shown, the arms of two core elements of small figures are removed, and the torso construct elements 201 are separated from the remainders 2302, 2303 of the core elements (that is, the waist construct elements 101 and the legs 402, 403). The two separated torso construct elements 201 are combined and a waist construct element 101 from the combiner set 2001 is added to create the trunk 2102. Four combiner assemblies 1701 (two of each orientation) from the combiner set 2001 are added to the trunk 2102 to create the core element of the large construct 2201 (FIGS. 22A and 22B). The two core elements 2305 and 2307 of the remaining two small constructs are attached to two (that is, 2310, 2311) of combiner assemblies 1701 of different orientations that are attached to the joint elements of the waist construct element 101 of the trunk 2102 of the large construct by inserting their neck posts 214 into the bore holes 1630 of the combiner assemblies 1701 to form the legs 2320 of the large construct. The remainders 2302 and 2303 of the other cores of the small constructs are inserted into the other two (2217, 2219) of the combiner assemblies 1701 of different orientations that are attached to the joint elements of the upper torso construct element 201 of the trunk 2102 of the large construct by insert their spine posts 130 into the bore holes 1630 of the combiner assemblies 1701 to form the arms 2330 of the large construct. A head building element 416 is added to the neck post 214 of the upper torso construct element 201 of the trunk 2102 to complete the large FIG. 2301 of the large construct.

Figure 24A:
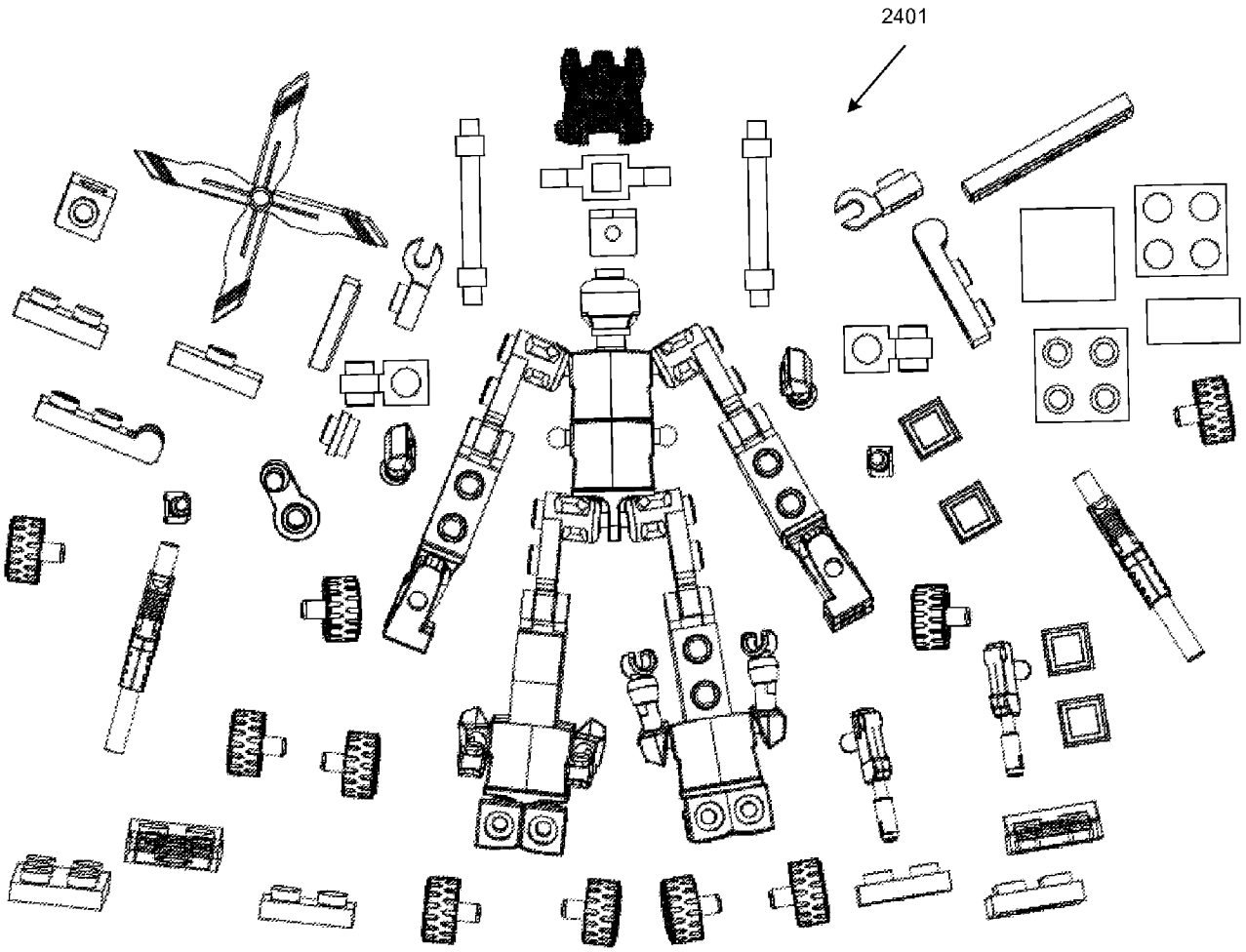
FIG. 24A is a partially exploded perspective view of the parts from a collection of first through fourth small constructs used to assemble a large construct.
Figure 24B:
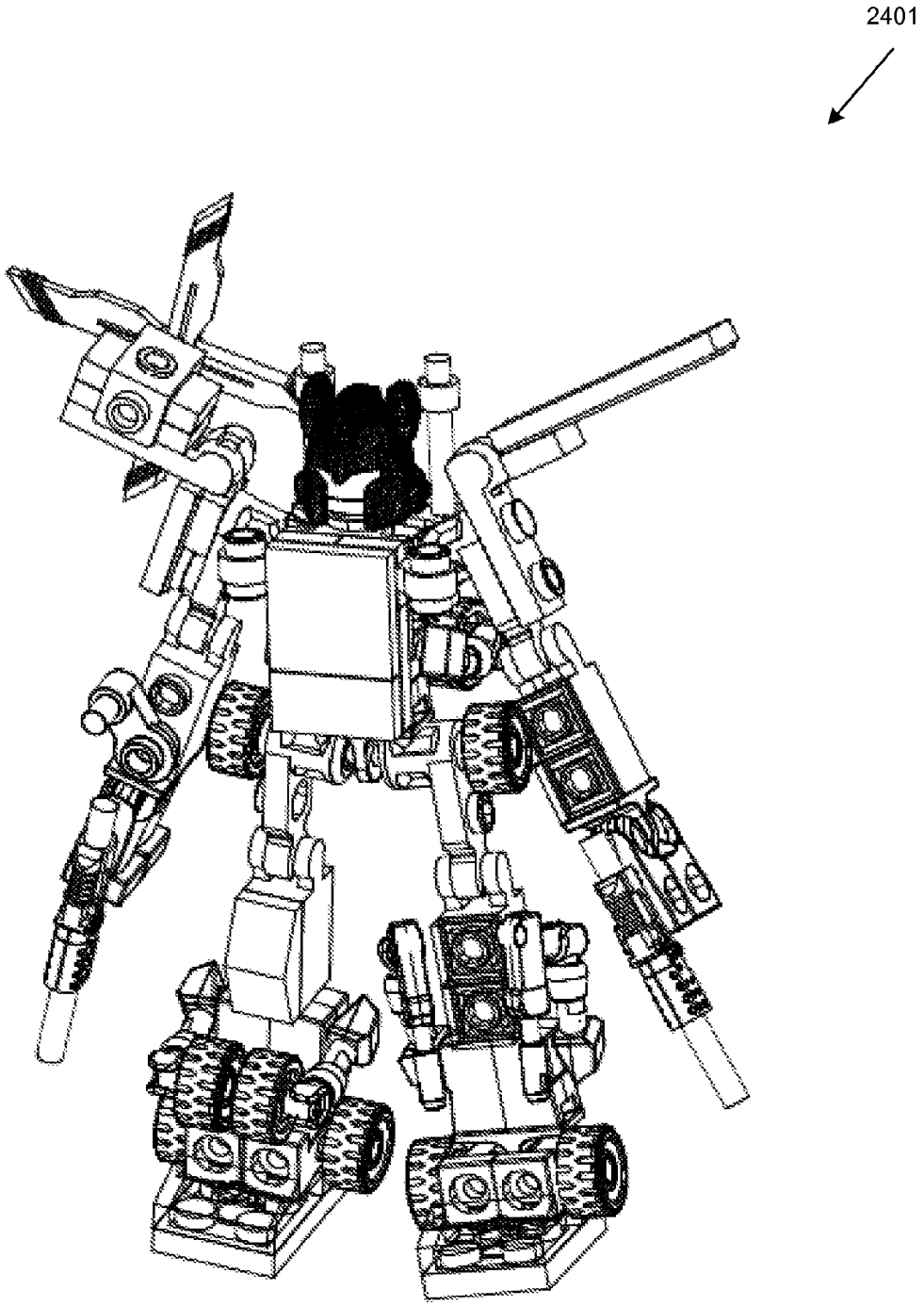
FIG. 24B is a perspective view of an assembled exemplary large construct.

FIG. 24A is a partially exploded perspective view of the assembly of a large construct 2401 created from the additional parts of the small constructs from a collection of first through fourth small constructs added to the large FIG. 2301. FIG. 24B is a perspective view of the assembled exemplary large construct 2401.

Sets of small constructs can be specifically designed and created with a coherent theme or set of related parts to be assembled into a specific designed build of a large construct making collecting of the sets of different small constructs desirable and fun. In addition, because of the standardized nature of the build elements and parts of the small constructs, any four small constructs (for example, from different sets) also can be combined to form a large construct of another build, whether by specific design or of the end user's own design or creation. Furthermore, because of the standardized nature of the building elements of toy construction sets, any number of parts and pieces from these standardized sets can be used in the creation of a large construct by adding these parts as desired by the end user.

A number of exemplary implementations have been described. Nevertheless, other implementations are within the scope of the following claims.

What is claimed is:

1. A large toy construct configured for use with standardized toy construction building elements having standardized male and female coupling elements, the large toy construct assembled from a plurality of small toy constructs and a combiner assembly set, wherein each small toy construct comprises a small toy figure including a small core building element and additional build parts that may be assembled to create the small toy construct and then dissembled into its constituent parts, the small core building element comprising a torso construct building element and a waist construct building element, the construct building elements including a plurality of joint elements, and the combiner assembly set including a waist construct building element and a plurality of hinged combiner assemblies, the large toy construct comprising:

a large toy figure comprising:

a trunk building element comprising:

a first torso construct building element of a small toy figure of a first small toy construct removeably attached to a second torso construct building element of a small toy figure of a second small toy construct that is removeably attached to the waist construct building element of the combiner set;

a first pair of hinged combiner assemblies, one of the hinged combiner assemblies of the first pair assembled in a first orientation and the other of the hinged combiner assemblies of the first pair assembled in a second orientation, each of the hinged combiner assemblies of the first pair comprising a first special connector removeably attached to a second special connector, the first special connectors of the hinged combiner assemblies of the first pair each removeably attached to one of the two joints of the first torso construct building element;

a second pair of hinged combiner assemblies, one of the hinged combiner assemblies of the second pair assembled in the first orientation and the other of the hinged combiner assemblies of the second pair assembled in the second orientation, each of the hinged combiner assemblies of the second pair comprising a first special connector removeably attached to a second special connector, the second special connectors of the combiner assemblies of the second pair each removeably attached to one of the two joints of the waist construct building element of the combiner set;

a pair of small core building elements of a small toy figure of a third and fourth small toy construct removeably attached to the second special connectors of the second pair of hinged combiner elements; and a pair of remainders of the small core building elements of the small toy figures of the first and second small toy constructs, removeably attached to the second special connectors of the first pair of hinged combiners.

2. The large toy construct of claim 1 wherein removeably attached elements are removeably attached with an interference fit.

3. The large toy construct of claim 1 wherein the first special connectors each include a socket removeably attached to a joint of the attached construct elements using a snap fit and the second special connectors include a bore hole removeably attached to a post of the attached construct elements using a non-snap, friction fit.

4. The large toy construct of claim 1 wherein the first special connectors each include a socket removeably attached to a joint of the attached construct elements using a snap fit to create a joint system having a range of motion in three dimensions.

5. The large toy construct of claim 1 wherein the first special connector includes a C grip of the second coupling size that is removeably attached using a snap fit to a rod of a hinge portion of the second special connector to form a hinged joint system.

6. The large toy construct of claim 1 wherein each of the small toy constructs are configured to be assembled into two different builds using specific parts of each small toy construct that are removeably attached to the core elements of each small figure of the small toy constructs to create the two different builds that are distinct for each small toy construct, and the large toy construct further comprises a plurality of parts removeably attached to the large toy figure to create the large toy construct, the plurality of parts including at least one specific part from each small construct of the first small construct, the second small construct, the third small construct, and the fourth small construct.

7. The large toy construct of claim 6 wherein the two different builds are a robotic build and a vehicle build.

8. The large toy construct of claim 5 wherein the hinge joint system provides a range of motion for the first and second special connectors of at least 180 degrees within a plane orthogonal to the longitudinal axis of the rod.

9. The large toy construct of claim 5 wherein the first special connector includes an arm portion arranged in a first plane and a generally cylindrical portion extending orthogonally from one end of the arm portion to a rounded end, the rounded end including a socket removeably attached to a joint of the attached construct element using a snap fit, and the C grip disposed at another end of the arm portion in the first plane and having a longitudinal axis or axis of rotation orthogonal to the first plane and coincident with the longitudinal axis of the rod.

10. The large toy construct of claim 1 wherein the first special connector and the second special connector each include at least one male coupling element and at least one female recess sized to receive the male coupling element.

11. The large toy construct of claim 1 wherein each of the small toy constructs includes parts of the small toy construct that are removeably attached to the core elements of each small toy figure of the small toy constructs to create a build of the small toy construct, and the large toy construct further comprises a plurality of the parts of the small toy constructs attached to the large toy figure to create the large toy construct, the plurality of parts including at least one part attached to at least one of the male connectors of each first and second special connectors.

12. The large toy construct of claim 1 wherein the large toy figure comprises a head building element.

13. A combiner assembly set for a large toy construct configured for use with a standardized toy construction building elements having standardized male and female coupling elements providing the large toy construct assembled from multiple small toy constructs including construct building elements, the combiner assembly set comprising:

one or more hinged combiner assemblies, each hinged combiner assembly comprising:

a first special connector including:

a socket located proximal to one end of the first special connector and sized to mate with a joint element of a construct building element of a small toy construct used to assemble the large toy construct via a snap fit; and a C grip disposed at another end of the first special connector; and a second special connector including:

a hinge portion configured at one end of the second special connector, the hinge portion including a rod removably attached to the C grip of the first special connector via a snap fit in either one of two orientations that are 180 degrees opposite of each other to create a hinged joint system; and a bore hole configured at an opposite end of the second special connector and of size and depth to receive a post of a construct building element of any of the small toy constructs used to assemble of the large toy construct.

14. The combiner assembly set of claim 13 wherein the hinge joint system provides a range of motion for the first and second special connectors of at least 180 degrees within a plane orthogonal to the longitudinal axis of the rod.

15. The combiner assembly set of claim 13 wherein the first special connector includes an arm portion arranged in a first plane and a generally cylindrical portion extending orthogonally from one end of the arm portion to a rounded end of the cylindrical portion, the socket being disposed in the rounded end of the cylindrical portion, and the C grip disposed at another end of the arm portion in the first plane and having a longitudinal axis or axis of rotation orthogonal to the first plane.

16. The combiner assembly set of claim 13 wherein the first special connector and the second special connector each include at least one male coupling element and at least one female recess sized to receive the male coupling element.

17. The combiner assembly set of claim 13 wherein the coupling elements of the standardized toy construction building elements have a first coupling size and the rod has a second coupling size.

18. The combiner assembly set of claim 13 further comprising a construct building element including two joint elements.

19. The combiner assembly set of claim 13 comprising a plurality of hinged combiner assemblies.

20. A toy construct assembly system comprising:

two or more small toy constructs, each small toy construct comprising a plurality of building elements that assemble to create an assembled small toy construct build, a small toy construct having at least two distinct assembled builds, the at least two distinct assembled builds being assembled in a distinct manner;

a large construct combiner assembly set including a plurality of combiner assemblies configured to detachably couple with building elements of any of the small toy constructs, each combiner assembly comprising a hinge region, a first connection area having a first connection mechanism, and a second connection area having a second connection mechanism that is distinct from the first connection mechanism;

wherein:

the first connection mechanism of the combiner assembly connects to a first mating connection mechanism of at least one of the building elements of each small toy construct; and the second connection mechanism of the combiner assembly connects to a second mating connection mechanism of at least one of the building elements of each small toy construct; and a large toy construct assembled from at least two of the small toy constructs and the large construct combiner assembly set, wherein the assembled large toy construct comprises at least a plurality of building elements that are detached from any of the small toy constructs, at least some of the detached building elements are attached to respective combiner assemblies using the first connection mechanism and at least some of the detached building elements are attached to respective combiner assemblies using the second connection mechanism.

21. The toy construct assembly system of claim 20 wherein one assembled build of the small toy construct is a vehicle and another assembled build of the same small toy construct is a robot.

22. The toy construct assembly system of claim 20 wherein the combiner assembly comprises:

a first special connector including:

a socket located proximal to one end of the first special connector and sized to mate with a joint element of one of the building elements via a snap fit, wherein the first connection area includes the socket and the first connection mechanism is the snap fit and a first hinge device disposed at another end of the first special connector; and a second special connector including:

a second hinge device at one end of the second special connector, the second hinge device removably attachable to the first hinge device of the first special connector to create the hinge region; and a hole configured at an opposite end of the second special connector and configured to receive a post of one of the building elements used to assemble of the large toy construct, wherein the second connection area includes the hole of the second special connector and the second connection mechanism is an interference fit between the hole and the post.

23. The combiner assembly of claim 22 wherein the hinge region has a range of motion for the first and second special connectors of at least 180 degrees.

24. The combiner assembly of claim 22 wherein the first special connector includes an arm portion arranged in a first plane and a generally cylindrical portion extending orthogonally from one end of the arm portion to a rounded end of the cylindrical portion, the socket being disposed in the rounded end of the cylindrical portion, and the first hinge device disposed at another end of the arm portion in the first plane and having a longitudinal axis or axis of rotation orthogonal to the first plane.

25. The combiner assembly of claim 22 wherein the first special connector and the second special connector each include a male coupling element and at least one female recess sized to receive the male coupling element.

* * * * *